US007386257B2

(12) United States Patent
Koike et al.

(10) Patent No.: US 7,386,257 B2
(45) Date of Patent: Jun. 10, 2008

(54) IMAGING APPARATUS, AND TONER AND PROCESS CARTRIDGE USED IN THE IMAGING APPARATUS

(75) Inventors: Toshio Koike, Kanagawa (JP); Eisaku Murakami, Tokyo (JP); Masato Yanagida, Tokyo (JP); Takeshi Shintani, Kanagawa (JP); Naohiro Kumagai, Kanagawa (JP); Atsushi Sampe, Kanagawa (JP); Masami Tomita, Shizuoka (JP); Hiroyuki Nagashima, Kanagawa (JP); Masanori Kawasumi, Kanagawa (JP); Takeshi Uchitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 11/377,180

(22) Filed: Mar. 17, 2006

(65) Prior Publication Data

US 2006/0177239 A1 Aug. 10, 2006

Related U.S. Application Data

(63) Continuation of application No. 10/820,726, filed on Apr. 9, 2004, now Pat. No. 7,050,741.

(30) Foreign Application Priority Data

Apr. 10, 2003 (JP) ..... 2003-106100

(51) Int. Cl.
*G03G 15/00* (2006.01)

(52) U.S. Cl. ..... 399/159

(58) Field of Classification Search ..... 399/107, 399/116, 159, 252, 111, 303, 308; 430/110.1, 430/110.3, 111.41
See application file for complete search history.

(56) References Cited

U.S. PATENT DOCUMENTS

| | | | | |
|---|---|---|---|---|
| 6,269,228 | B1 | 7/2001 | Kayahara et al. | |
| 6,560,427 | B2 | 5/2003 | Kubo et al. | |
| 6,608,984 | B1 | 8/2003 | Matsumoto et al. | |
| 6,939,651 | B2 * | 9/2005 | Li et al. | 430/66 |
| 7,005,223 | B2 | 2/2006 | Yamashita et al. | |
| 7,295,788 | B2 * | 11/2007 | Nakai et al. | 399/44 |
| 2002/0009316 | A1 | 1/2002 | Endo et al. | |
| 2002/0039698 | A1 | 4/2002 | Sasaki et al. | |

(Continued)

FOREIGN PATENT DOCUMENTS

| | | |
|---|---|---|
| JP | 05-094033 | 4/1993 |

(Continued)

*Primary Examiner*—Hoan Tran
(74) *Attorney, Agent, or Firm*—Oblon, Spivak, McClelland, Maier & Neustadt, P.C.

(57) ABSTRACT

An imaging apparatus that is capable of realizing good cleaning characteristics and transfer characteristics, and obtaining a high quality image using toner having a high average roundness is provided. The imaging apparatus includes an image carrier, a charge unit, a developing unit, a transfer unit, and a cleaning unit. The transfer unit may directly transfer a toner image onto a recording medium that is carried by a transfer belt, or transfer the toner image onto the transfer belt first to then transfer the toner image onto the recording medium from the transfer belt. The cleaning unit includes a cleaning blade and a brush roller. The toner used in the imaging apparatus has an average roundness Ψ within a range of 0.93~0.99, and a friction coefficient μs of the image carrier satisfies a condition, friction coefficient μs≦3.6−3.3×average roundness Ψ.

3 Claims, 6 Drawing Sheets

U.S. PATENT DOCUMENTS

| | | | | |
|---|---|---|---|---|
| 2003/0190543 | A1 | 10/2003 | Sugiura et al. | |
| 2005/0244176 | A1* | 11/2005 | Nakai et al. | 399/44 |

FOREIGN PATENT DOCUMENTS

| | | |
|---|---|---|
| JP | 5-107990 | 4/1993 |
| JP | 8-248849 | 9/1996 |
| JP | 2000-231286 | 8/2000 |
| JP | 2000-267536 | 9/2000 |
| JP | 2000-293050 | 10/2000 |
| JP | 2000-305343 | 11/2000 |
| JP | 2001-282043 | 10/2001 |
| JP | 2002-031997 | 1/2002 |
| JP | 2002-107976 | 4/2002 |
| JP | 2002-278224 | 9/2002 |
| JP | 2002-333805 | 11/2002 |
| JP | 2002-351143 | 12/2002 |
| JP | 2002-357929 | 12/2002 |
| JP | 2003-057996 | 2/2003 |
| JP | 2004-252226 | 9/2004 |

* cited by examiner

IMAGING APPARATUS, AND TONER AND PROCESS CARTRIDGE USED IN THE IMAGING APPARATUS

CROSS REFERENCE TO RELATED APPLICATIONS

This application is a continuation of U.S. application Ser. No. 10/820,726, filed on Apr. 9, 2004, now U.S. Pat. No. 7,050,741 and is based upon and claims the benefits of priority from prior Japanese Patent Application No. 2003-106100, filed on Apr. 10, 2003, each of which is hereby incorporated by reference in their entirety.

BACKGROUND OF THE INVENTION

1. Field of the Invention

The present invention relates to an electrophotographic imaging apparatus such as a copying machine, a laser beam printer, and a facsimile machine, and a process cartridge and toner that are used in the electrophotographic imaging apparatus.

2. Description of the Related Art

Conventionally, in the field of electrophotographic imaging apparatuses such as copying machines, laser beam printers, and facsimile machines, an imaging technique of forming a latent image by charging a surface of a photoconductor corresponding to an image carrier is known.

Currently, a technique is being developed for decreasing the particle diameter and increasing the roundness of toner used in an imaging apparatus in order to improve the output image quality. In such case, there is a limit to decreasing the particle diameter and increasing the roundness of the toner produced by a conventional pulverization method. Thereby, toner produced by a polymerization method is starting to be used to further decrease the particle diameter and increase the roundness of toner. The polymerization method includes suspension polymerization, emulsification polymerization, and dispersion polymerization, for example, which enable production of round toner particles.

It is known that toner with high roundness has inferior cleaning characteristics. Particularly, toner produced by the polymerization method may have roundness close to a sphere (e.g., average roundness of 0.98 or more), and thereby, it is difficult to clean the polymerized toner by means of a conventional cleaning method for pulverized toner using a cleaning blade. Specifically, the toner particles of the polymerized toner may not be stuck to the edge of the cleaning blade, and may instead slide across the image carrier (photoconductor) surface. Thereby, the toner particles are prone to pass around the cleaning blade, causing a fault in the cleaning process. It is noted that the method for cleaning the toner particles is not limited to the blade cleaning method, and other methods such as brush cleaning, magnetic brush cleaning, and electrostatic brush cleaning may be used as well. From the aspect of cleaning performance and cost, a combination of the blade cleaning method and the brush cleaning method is generally used. A number of techniques have been proposed in the prior art for improving the toner cleaning performance for very round toner particles.

For example, Japanese Patent Laid-Open Publication No. 5-107990 discloses a cleaning apparatus implementing a pre-cleaning charge unit for applying an electric charge with the same polarity as that of the toner to an upstream side of a conductive brush of an image carrier, a bias applying member attached to the conductive brush and including at least a bias with an opposite polarity to that of the charge of the pre-cleaning unit, and, if desired, a pre-cleaning exposure unit that is positioned at the same region as that of the pre-cleaning charge unit or positioned downstream of the pre-cleaning charge unit and upstream of the conductive brush, wherein a charge with the same polarity as that of the toner is applied to the image carrier by the pre-cleaning charge unit to neutralize the charge of carriers residing in small amounts on the surface of the image carrier and to reduce the adhesiveness of the carriers to the image carrier. In this way, carriers on the image carrier may be removed, and the carriers may be prevented from reaching a blade region so that the image carrier surface at the blade region may be protected from damage. However, since the charge of the toner on the image carrier is increased in this example, electrostatic attraction between the toner and the image carrier (photoconductor) is increased, and blade cleaning becomes difficult for very round toner particles.

Also, Japanese Patent Laid-Open Publication No. 8-248849 discloses a cleaning apparatus implementing a direct current power source and an indirect current power source that apply to a cleaning brush a direct current and an indirect current that are superimposed on each other, the direct current power source and the indirect current power source being positioned upstream of the cleaning brush with respect to a rotational direction of a photoconductor and downstream of a transfer unit with respect to the rotational direction of the photoconductor. In this way, the surface of the photoconductor may be arranged to have the same polarity as that of a remaining developing agent so that the electrostatic attraction of the developing agent to the photoconductor may be weakened to thereby improve the cleaning performance. However, according to the present related art example, the electric potential of the photoconductor surface is reversed so that the service life of the photoconductor may possibly be influenced.

Also, Japanese Patent Laid-Open Publication No. 2000-267536 discloses an imaging apparatus implementing an image carrier cleaning blade of which a blade edge is coated with a powdery mixture material. According to this example, a suitable toner dam may be formed at a nip of the image carrier and the blade edge from the initial stage of using the imaging apparatus, and spherical toner particles may be prevented from slipping past the blade even when a large amount of toner particles are applied to the blade edge. However, it is difficult to evenly apply the toner powdery mixture material on the surface of the blade, and problems also arise with respect to pressure resistance.

SUMMARY OF THE INVENTION

The present invention has been conceived in response to one or more problems of the related art, and its object is to provide an imaging apparatus that is capable of realizing good cleaning performance and good transfer characteristics, and obtaining a high quality image using toner with a high average roundness. It is also an object of the present invention to provide a process cartridge and toner that are used in such an imaging apparatus.

According to an aspect of the present invention, an imaging apparatus includes:

an image carrier that is adapted to form a latent image;

a charge unit that is adapted to charge the image carrier;

a developing unit that is adapted to develop the latent image formed on the image carrier with toner to form a toner image;

a transfer unit that is adapted to either directly transfer the toner image onto a recording medium that is carried by a transfer belt, or transfer the toner image onto the transfer belt first to then transfer the toner image onto the recording medium from the transfer belt; and a cleaning unit including a cleaning blade and a brush roller; wherein an average roundness Ψ of the toner is within a range of 0.93~0.99; and a friction coefficient μs of the image carrier satisfies a condition, friction coefficient μs≦3.6−3.3×average roundness Ψ.

According to an embodiment of the present invention, the brush roller of the cleaning unit may be adapted to have metal salt of aliphatic acid applied thereon with a force greater than or equal to 500 mN, after which the brush roller may apply the metal salt of aliphatic acid on the image carrier.

According to another embodiment of the present invention, the metal salt of aliphatic acid may correspond to stearic acid.

According to another embodiment of the present invention, the metal salt of aliphatic acid may be formed into a bar shape and function as a flicker.

According to another embodiment, the friction coefficient of the image carrier may be in a range of 0.4~0.1.

According to another embodiment, the brush roller may include at least one of a conductive material and a semi-conductive material, and may be adapted to apply a bias voltage that is obtained by superimposing an indirect current on a direct current that is of an opposite polarity of a charge polarity of residual toner that is left on the image carrier when developing the latent image on the image carrier.

According to another embodiment of the present invention, the image carrier may implement a protective layer including a filler.

According to another embodiment, the filler included in the protective layer may correspond to alumina.

According to another embodiment of the present invention, the charge member and the image carrier may be separated from each other so that the charge member does not come into contact with the toner, the distance between the charge member and the image carrier being less than or equal to 80 μm.

According to another embodiment of the present invention, a volume average particle diameter Dv of the toner may be in a range of 3~8 μm, and a dispersity of the toner that is defined by a ratio between the volume average particle diameter Dv and a number average particle diameter of Dn of the toner (Dv/Dn) may be in a range of 1.05~1.40.

According to another embodiment of the present invention, a shape factor SF-1 of the toner may be in a range of 100~180, and a shape factor SF-2 of the toner may be in a range of 100~180.

According to another embodiment of the present invention, the toner may include spindle shaped particles of which a ratio between a minor axis r2 and a major axis r1 (r2/r1) is in a range of 0.5~0.8, and a ratio between a thickness r3 and the minor axis r2 (r3/r2) is in a range of 0.7~1.0, the major axis r1, the minor axis r2, and the thickness r3 satisfying a condition, r1>r2≧r3.

According to another embodiment of the present invention, the toner may be formed by causing at least one of a cross-linking reaction and an elongation reaction on a toner material in a water-based medium under the existence of resin particles, the toner material including polyester prepolymer with a functional group having a nitrogen atom, polyester, a coloring agent, and a release agent.

According to another embodiment of the present invention, the toner may include at least one of silica and titania.

In another aspect of the present invention, a process cartridge that is detachably implemented in an imaging apparatus is provided, the process cartridge being engaged to an image carrier that forms a latent image, and at least one of a charge unit, a developing unit, and a cleaning unit, and including:

a body that accommodates toner with an average roundness Ψ in a range of 0.93~0.99; wherein a friction coefficient μs of the image carrier satisfies a condition, friction coefficient μs≦3.6−3.3×average roundness Ψ.

In another aspect of the present invention, a toner is provided that is used in an imaging apparatus including an image carrier that is adapted to form a latent image, a charge unit that is adapted to charge the image carrier, a developing unit that is adapted to develop the latent image formed on the image carrier with toner to form a toner image, a transfer unit that is adapted to conduct at least one of a process of directly transferring the toner image onto a recording medium that is carried by a transfer belt, and a process of transferring the toner image onto the transfer belt and then transferring the toner image onto the recording medium from the transfer belt, and a cleaning unit including a cleaning blade and a brush roller, the toner including:

toner particles with an average roundness Ψ in a range of 0.93~0.99; wherein a friction coefficient μs of the image carrier satisfies a condition, friction coefficient μs≦3.6−3.3×average roundness Ψ.

BRIEF DESCRIPTION OF THE DRAWINGS

FIGS. 8A and 8B are diagrams illustrating a spindle shaped toner particle, wherein FIG. 8A shows an external view of the toner particle, and FIG. 8B shows cross-sectional views of the toner particle.

DESCRIPTION OF THE PREFERRED EMBODIMENTS

In the following, preferred embodiments of the present invention are described with reference to the accompanying drawings.

Figure 1:
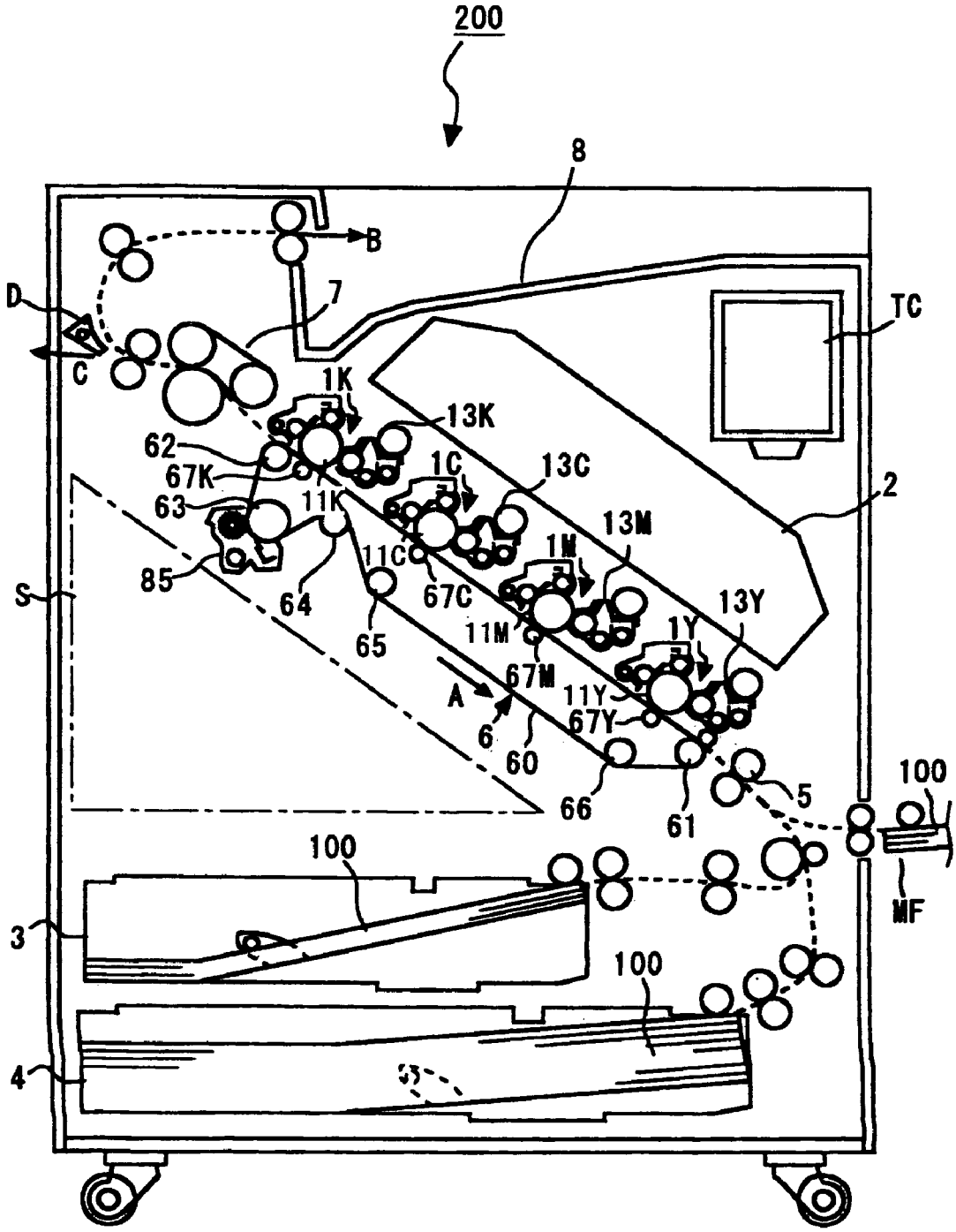
FIG. 1 is a schematic diagram showing a configuration of an imaging apparatus according to an embodiment of the present invention.
Figure 2:
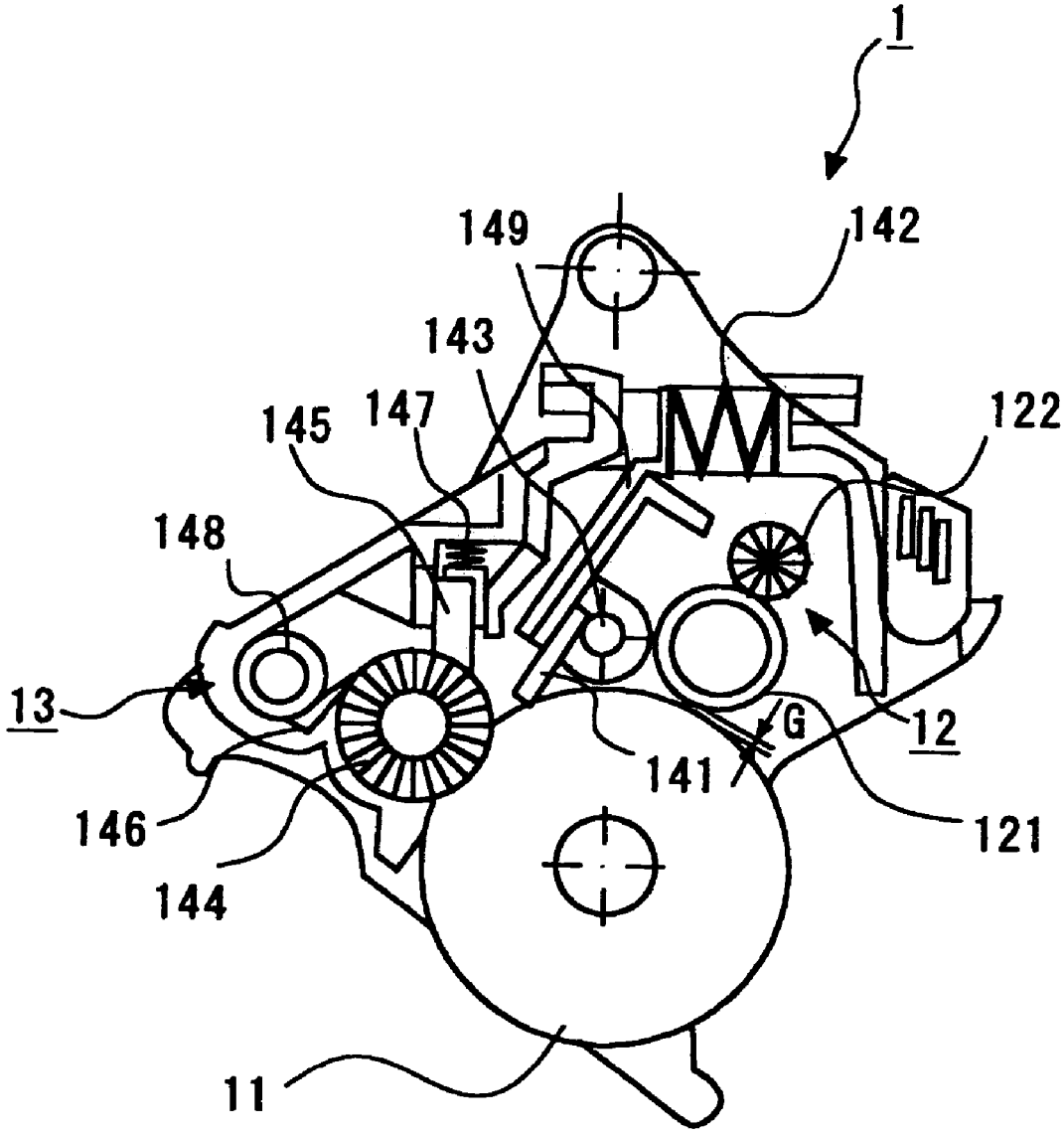
FIG. 2 is a diagram showing an exemplary configuration of an image forming unit of the imaging apparatus shown in FIG. 1.

FIG. 1 is a schematic diagram showing a configuration of an imaging apparatus 200 according to an embodiment of the present invention. FIG. 2 is a schematic diagram showing a configuration of an image forming unit 1 of the imaging apparatus 200 shown in FIG. 1. The imaging apparatus 200 includes four image forming units 1Y, 1M, 1C, and 1K for forming images in colors yellow (Y), magenta (M), cyan (C), and black (K). The image forming units 1Y, 1M, 1C, and 1K respectively include image carriers 11Y, 11M, 11C, and 11K, charge units 12Y, 12M, 12C, and 12K, developing units 13Y, 13M, 13C, and 13K, and cleaning units 14Y, 14M, 14C, and 14K. The image forming units 1Y, 1M, 1C, and 1K are positioned so that the rotational axes of their respective image carriers 11Y, 11M, 11C, and 11K may be parallel, and the image forming units 1Y, 1M, 1C, and 1K are aligned at predetermined pitches along a moving direction of a recording medium 100 such as paper.

On the upper side of the image forming units 1Y, 1M, 1C, and 1K, an optical write unit 2 including a light source, a polygon mirror, an f-θ lens, and a reflection mirror, for example, is implemented. The optical write unit 2 is adapted to irradiate and scan a laser beam over the surfaces of the image carriers 11Y, 11M, 11C, and 11K, based on image data. On the lower side of the image forming units 1Y, 1M, 1C, and 1K, a transfer unit 6 as a belt drive unit is implemented, the transfer unit 6 including a transfer carrier belt 60 that holds the recording medium 100 and carries it through transfer modules of the image forming units 1Y, 1M, 1C, and 1K. At the side of the transfer unit 6, a fixing unit 7 and a delivery tray 8, for example, are implemented. The fixing unit 7 includes a heating roller that implements a heating element within, and a fixing belt that is held by the heating roller and a driven roller.

At a lower section of the imaging apparatus 200, paper feeding cassettes 3 and 4 that accommodate the recording media 100 are implemented. Also, the imaging apparatus 200 includes a manual feeding tray MF for manually feeding a recording medium such as paper from a side of the imaging apparatus 200. Additionally, the imaging apparatus 200 includes a toner supply container TC, as well as a waste toner bottler, a dual side/reversal unit, and a power source unit (not shown), for example, that are implemented in a space S indicated by the dotted-dashed line in FIG. 1.

Referring to FIG. 2, an image forming unit 1 (corresponding to any one of the image forming units 1Y, 1M, 1C, and 1K of FIG. 1) includes an image carrier 11, a charge unit 12, a developing unit 13 (not shown in FIG. 2), and a cleaning unit 14.

The imaging apparatus 200 uses toner that has an average roundness Ψ within a range of 0.93~0.99. It is noted that when toner having an average roundness below 0.93 is used, a desired high transferability may not be achieved and obtaining a high quality image may be difficult due to toner scattering occurring in the image transfer process. On the other hand, when the average roundness of the toner exceeds 0.99, a large amount of time is required in processing the toner particles into spherical configurations, and a large amount of toner is discarded in a sorting process so that productivity is lowered and use of such toner becomes impractical.

The average roundness of toner corresponds to a value obtained by optically measuring a toner particle and dividing a measured dimension of the toner particle by the circumference of a circle having an area equivalent to a projected area of the toner particle. Specifically, using a flow type particle image analyzing apparatus (FPIA-2100 by Toa Medical Electronics Co. Ltd.), 0.1~0.5 mL of a surfactant as a dispersing agent is added to 100~150 mL of water held in a container from which water impure solid matter is removed beforehand. Then, about 0.1~9.5 g of a measurement sample is added to the water. Then, a dispersion process is performed on the suspension containing the dispersed sample for about 1~3 minutes using an ultrasonic dispersing unit, and the concentration of the dispersed sample solution (suspension) is arranged to be around 3,000~10,000/μL to measure the shape and distribution of the toner particles.

It is noted that toner manufactured through dry pulverization may be thermally or mechanically processed to arrange the toner particles into spherical shapes. The thermal process of the toner particles may be realized, for example, by spraying toner base particles along with thermal airflow to an atomizer. The mechanical processing of the toner particles may be realized by injecting in a mixer apparatus such as a ball mill the base toner particles along with a mixing medium having low density such as glass, and mixing the materials together. However, in the thermal process for realizing round toner particles, the toner particles tend to stick to one other so that toner base particles with large particle diameters are created, and in the mechanical process, microscopic powder is generated so that a sorting process has to be performed. When toner is manufactured in a water-based solvent, the shapes of the toner particles may be controlled by vigorously mixing the toner base particles in a process of removing the solvent.

Also, a relation may be established between average roundness Ψ of the toner and a friction coefficient μs of the image carrier 11 as indicated below.

$$\text{Friction Coefficient } \mu s \leqq 3.6 - 3.3 \times \text{Average Roundness } \Psi$$

It is noted that when the average roundness Ψ of the toner is high, an image may be developed/transferred with high fidelity to the developing electric field/transfer electric field. Thereby, a high quality image may be formed, and high transferability may be achieved. However, the toner particles are more likely to roll over the image carrier 11, and slide through the gap between a cleaning blade 141 and the image carrier 11 to thereby cause cleaning defects. When the friction coefficient is small, the adhesiveness between the toner particles and the image carrier 11 is weakened, and high transferability may be obtained. Also, the toner particles may be removed from the image carrier with a small force that is less than that for the toner particles to remain rolling on the image carrier 11 so that the cleaning performance may be improved. However, an edge of a toner image on the image carrier 11 may be impaired owing to the scratching force of a magnetic brush used herein, for example, and the image quality may be degraded.

Accordingly, to obtain a high quality image and high transferability as well as to improve cleaning performance, the average roundness Ψ of the toner is preferably arranged to be within the range of 0.93~0.99, and the friction coefficient μs of the image carrier 11 is preferably arranged to be no more than 0.5 ($\mu s \leqq 0.5$). Also, as indicated above, the relation between the average roundness Ψ of the toner and the friction coefficient μs of the image carrier 11 is preferably arranged to satisfy the condition, Friction Coefficient $\mu s \leqq 3.6 - 3.3 \times$ Average Roundness Ψ. In this way, the problems describe above may be resolved. It is noted that when the friction coefficient μs is greater than 0.5, cleaning defects may occur upon using toner having an average roundness of 0.93~0.99.

It is preferred that the friction coefficient be set to 0.5 or lower, and more preferably, within a range of 0.4~0.1. By setting the friction coefficient to 0.5 or lower, friction between the cleaning blade 141 and the image carrier 11 may be prevented from increasing, curling or deformation of the cleaning blade 141 may be prevented, and screeching due to an oscillation of the cleaning blade 141 may be prevented. The friction coefficient is preferably set to 0.4 or lower. Further, a friction coefficient that is less than or equal to 0.3 may be even better. However, when the friction coefficient is lower than 0.1, the toner particles may slide excessively between the image carrier 11 and the cleaning blade 141 so that the toner particles on the image carrier 11 may pass around the cleaning blade 141 to thereby cause cleaning defects.

The friction coefficient of the image carrier 11 may be measured using an oiler belt system as described below.

Figure 3:
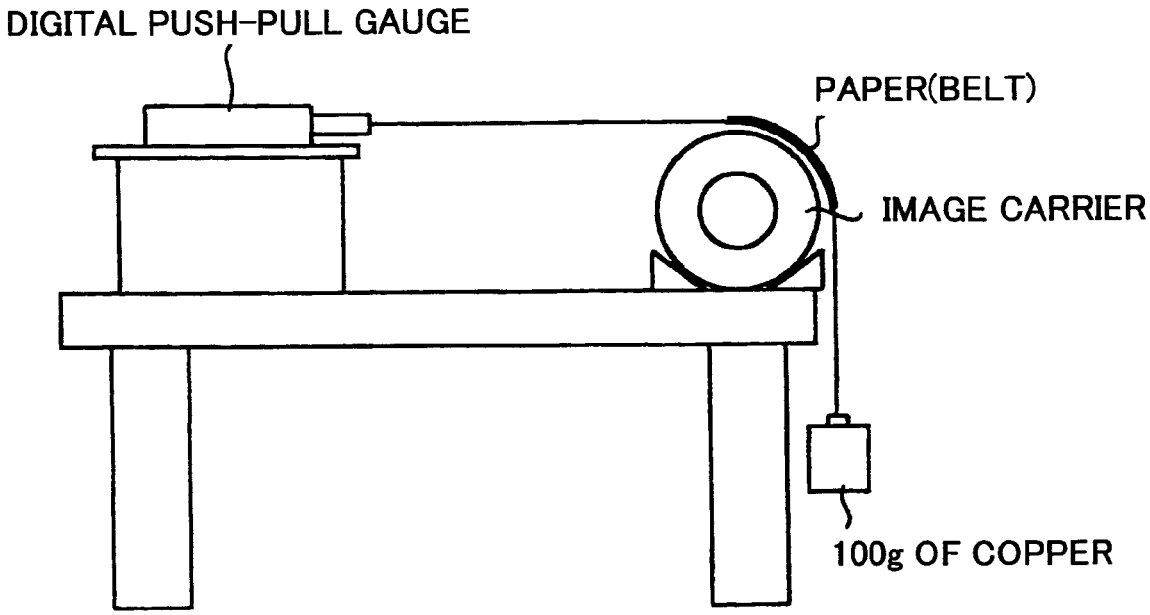
FIG. 3 is a diagram illustrating a method of measuring a friction coefficient of an image carrier.

FIG. 3 is a diagram illustrating a method of measuring a friction coefficient of an image carrier. In this drawing, a sheet of medium thickness bond paper as a belt is placed over a quarter (¼) of the drum circumference of the image carrier 11. On one side of the belt, a load of 0.98 N (100 g), for example, is applied, and on the other side of the image carrier 11, a force gauge is implemented. The load is measured at the time when the force gauge is pulled and the belt is moved, and the measured value is substituted into an equation shown below.

$$\text{Friction Coefficient } \mu s = 2/\pi \times 1n\ (F/0.98)$$

(wherein, μ: static friction, and F: measured value)

The friction coefficient of the image carrier 11 of the imaging apparatus 200 corresponds to a value obtained when the imaging apparatus 200 is in a steady state. Specifically, the friction coefficient of the image carrier 11 is influenced by other units implemented in the imaging apparatus 200, and thereby, the value of the friction coefficient fluctuates right after an imaging operation is started. However, for example, after imaging is performed on approximately 1,000 pages of A4 recording paper, a substantially stable value may be obtained for the friction coefficient. This stabilized value for the friction coefficient corresponds to the friction coefficient obtained in a stable state of the imaging apparatus.

The cleaning unit 14 of the imaging apparatus 200 includes the cleaning blade 141, a brush type roller 144, and a waste toner collecting coil 148. The cleaning blade 141 and the brush type roller 144 are for cleaning the toner particles remaining on the image carrier 11 after a transfer process of the toner image is completed.

The cleaning blade 141 may use elastomer such as fluorine rubber, silicon rubber, or polyurethane rubber as its material. Particularly, polyurethane elastomer containing polyurethane rubber is preferred from the point of abrasion resistance, ozone resistance, and contamination resistance. The cleaning blade 141 is attached to a support member 149 in the cleaning unit 14. The support member 149 is not limited to a particular configuration, and may be implemented by metal, plastic, or ceramic, for example. Metal is preferably used since a certain amount of durability is desired in the support member 149, particularly, an SUS steel plate, an aluminum plate, or a phosphor bronze copper plate, for example, is preferably used. In attaching the cleaning blade 141 to the support member 149, for example, adhesive may be applied to the support member 149 to attach the cleaning blade 141 to the support member 149 after which heat or pressure may be applied to bind the two components. Also, the cleaning blade 141 is able to rotate by means of a blade pressurizing spring 142 that is engaged with the support member 149, the cleaning blade 141 rotating with a blade rotation fulcrum 143 as its rotational axis and applying force to the image carrier 11 with a fixed pressure.

The polyurethane elastomer used as the material for the cleaning blade 141 may further include a strengthener (e.g., carbon black, clay), a softener (e.g., paraffin oil), a thermal resistance enhancing agent (e.g., antimony trioxide), and a coloring agent (e.g., titanium oxide). Such a cleaning blade 141 is manufactured as follows.

First, a mold is prepared for molding the cleaning blade 141. Meanwhile, polyisocyanate, polyol, and the strengthener are mixed in a container, and the mixture is poured into the mold, after which heat is applied to induce a hardening reaction so as to harden the material. Then, the molded material corresponding to a polyurethane rubber constituent article is removed from the mold. This polyurethane rubber constituent article may be cut into a blade structure, and the edges of the blade structure may be processed to produce a blade structure molded article.

The hardness of the cleaning blade 141 of the cleaning unit 14 is preferably within a range of 65~85 degrees (JIS-A). When the hardness of the cleaning blade 141 is below 65, the cleaning blade may be prone to deformation, making cleaning of the toner particles difficult. When the hardness of the cleaning blade 141 exceeds 85, a crack may be created at the edge of the cleaning blade 141. The thickness of the cleaning blade 141 is preferably arranged to be 0.8~3.0 mm, and a protruding length of the cleaning blade is preferably within the range of 3~15 mm. Also, it is noted that the cleaning blade 141 of the cleaning unit 14 maintains a consistent contact angle and contact force, and thereby, the cleaning blade is preferably fixed to the support member 149 or molded together as a unified component.

The contact force of the cleaning blade 141 upon being implemented to the cleaning unit 14 is preferably arranged to be within a range of 10~60 gf/cm. When the contact force is below 10 gf/cm, removal of toner particles below 2 μm may be difficult. When the tangent pressure is above 60 gf/cm, the edge of the cleaning blade 141 may be prone to curling and bounding may easily occur so that a cleaning defect such as tension may be generated, thereby degrading the cleaning performance. The tangent angle is preferably arranged to be within a range of 5~25 degrees from a tangent line extending from a tangent point. When the tangent angle is below 5 degrees, the toner particles are likely to pass around the cleaning blade, resulting in easy generation of cleaning defects. When the tangent angle is above 25 degrees, the cleaning blade may be prone to curling during the cleaning operation. The extent of insertion of the cleaning blade 141 into the image carrier 11 is preferably arranged to be within a range of 0.1~2.0 mm. When the extent of insertion is below 0.1 mm, the contacting area between the cleaning blade 141 and the image carrier 11 may is small, and the toner particles may easily slide past the cleaning blade, thereby causing cleaning defects. When the extent of insertion is above 2.0 mm, the friction between the cleaning blade 141 and the image carrier 11 is large, and curling of the cleaning blade 141 and bounding may easily occur. Also, cleaning defects such as screeching and tension due to blade oscillation may likely occur.

The cleaning unit 14 provided in the imaging apparatus 200 implements a brush roller 144 and is adapted to remove toner particles remaining on the image carrier 11. After a toner image is transferred to a recording medium 100, residual toner particles that remain stuck to the surface of the image carrier 11 are brushed off by the brush roller 144.

Then, the residual toner particles are removed from the brush roller 144 by a flicker, after which the waste toner collection coil 148 collects and discards the removed toner particles as waste toner into the waste toner bottle. The brush roller 144 includes a metal core that also functions as an electrode, and a brush structure that is formed by spirally winding to the metal core a pile fabric tape that has conductive or semiconductive resin fiber with a length of 5.0 mm, and a fineness of 3 denier formed thereon at 200,000 strands/inch$^2$. The brush roller 144 is adapted to rotate while touching the surface of the image carrier 11 at a predetermined peripheral speed in the same direction as the rotational direction of the image carrier 11. As for the resin fiber of the brush, nylon resin, polyester resin, or polypropylene resin may be used, for example. Particularly, a brush made of nylon resin is preferably used from the perspective of durability and duration of effects. It is noted that metallic powder of carbon black, copper, or aluminum, for example, may be added in order to adjust the electrical resistance. The fiber strand configuration of the brush may be roughly classified into an erect state and a loop state, and although differences in effectiveness exist, either state may be used.

The metal core of the brush roller 144 is adapted to receive a voltage from a power source, and cleaning may be performed by an electrostatic force. Accordingly, removal of the residual toner particles may be efficiently performed.

Upon conducting an image forming process of developing a latent image formed on the image carrier, a bias voltage is generated by superimposing an indirect voltage on a predetermined direct voltage with a polarity opposite to the charge polarity of toner remaining on the image carrier 11, and this bias voltage is applied to the metal core so that the residual toner particles may be electrostatically stuck to the brush roller 144 to thereby clean the image carrier 11. In the case where an image formation process is not conducted, only the predetermined direct voltage with a polarity opposite to the polarity of the residual toner particles is applied to the brush roller 144. In this way, when the amount of toner particles is small, the bias voltage applied to the image carrier may be kept low, so that the service life of the image carrier 11 may be augmented.

As is shown in FIG. 2, the brush roller 144 comes into contact with a coating bar 145 corresponding to a solidified bar-shaped metal salt of aliphatic acid to which a force of at least 500 mN is applied. The metal salt of aliphatic acid is rubbed onto the rotating brush roller 144 that comes into contact with the image carrier 11 thereafter to apply the metal salt of aliphatic acid onto the image carrier 11. The contacting direction of the brush roller 144 is preferably arranged to be in the same direction as the rotational direction of the image carrier 11. The metal salt of aliphatic acid applied to the image carrier 11 from the brush roller 144 is pressed by the cleaning blade 141 to form an even film on the cleaning blade 141 and the surface of the image carrier 11. By forming the metal salt of aliphatic acid film on the cleaning blade 141 and the image carrier 11, friction between the components may be reduced, and the components may slide smoothly against one another. By adjusting the amount of metal salt of aliphatic acid being applied, the friction coefficient of the image carrier 11 may be adjusted. Also, a portion of the film may adhere to the toner particles to be removed along with the toner particles and collected in the cleaning unit 14 as waste toner. Accordingly, in order to maintain the friction coefficient of the image carrier 11 to a stable value, a predetermined amount of metal salt of aliphatic acid has to be supplied.

When the force applied to the metal salt of aliphatic acid is below 500 mN, the amount of metal salt of aliphatic acid that is stuck to the brush roller 144 may be relatively small. Thereby, the amount of metal salt of aliphatic acid that is applied to the surface of the image carrier 11 may be small, and the friction coefficient of the image carrier 11 may not be effectively lowered. Thus, preferably, the coating bar 145 is pressed onto the brush roller 144 by a bar pressurizing spring 147, and a force of at least 500 mN is applied to the coating bar to apply the metal salt of aliphatic acid to the image carrier 11.

As the material of the metal salt of aliphatic acid, palmitic acid, heptadecylic acid, stearic acid, nonadecanoic acid, arachidic acid, behenic acid, lignoceric acid, cerotic acid, heptacosanic acid, montanoic acid, or melissic acid, for example, may be used as aliphatic acid, and, aluminum, manganese, cobalt, lead, calcium, chromium, copper, iron, magnesium, zinc, nickel, lithium, sodium, or strontium, for example, may be used as metal salt. Particularly, metal salt of palmitic acid such as aluminum palmitate, calcium palmitate, and magnesium palmitate, or metal salt of stearic acid such as aluminium stearate, calcium stearate, magnesium stearate, zinc stearate, and lead stearate, for example, are preferably used. Moreover, zinc stearate may be preferred from the aspect of increasing cleavage and decreasing the friction coefficient.

The cleaning unit 14 also includes a brush roller scraper 146 that comes into contact with the brush roller 144. The scraper 146 is positioned so that its edge is inserted into the brush roller 144 at a predetermined insertion degree, and the scraper 146 functions as a flicker that scratches off the residual toner particles removed from the image carrier 11 from the brush roller 144. The brush roller scraper 146 may include a scraper blade that is made of a PET sheet having a thickness of 0.2 mm and a free length of 4 mm, for example.

In an alternative embodiment, the brush roller scraper may not be implemented, and the coating bar 145 made of solidified metal salt of aliphatic acid may be used as a flicker instead.

Figure 4:
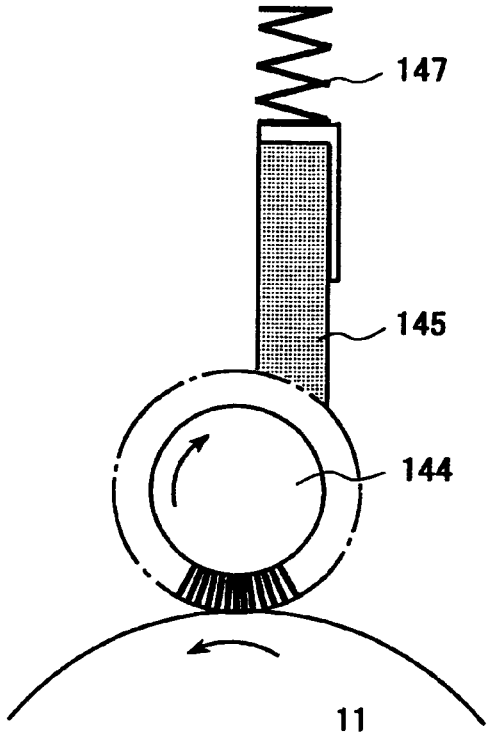
FIG. 4 is a diagram illustrating an exemplary configuration of a coating bar and a brush roller.

FIG. 4 is a diagram showing an exemplary configuration of the coating bar 145 and the brush roller 144. When the degree of insertion (I) of the coating bar 145 into the brush roller 144 is increased, the load of the brush roller 144 is increased. In turn, although good toner cleaning performance may initially be obtained, the fibers of the brush may bend from the pressure and the durability of the roller brush may be degraded. On the other hand, when the degree of insertion (I) of the coating bar 145 to the brush roller 144 is decreased, the toner cleaning performance of the brush roller may be degraded and problems of cleaning defects are generated from the start. Thereby, the degree of insertion (I) of the coating bar 145 is preferably arranged to be within a range at which the above problems can be avoided.

Figure 5:
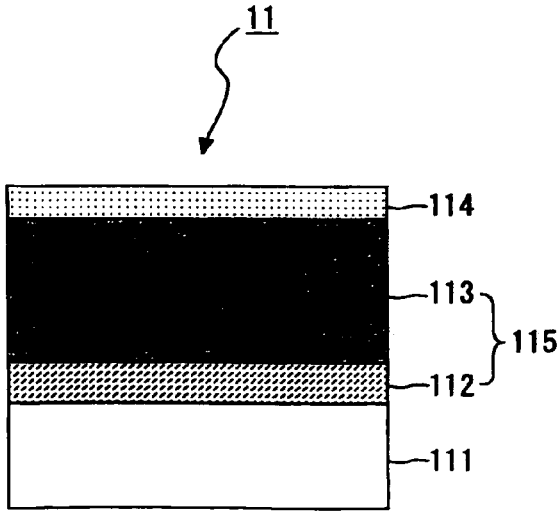
FIG. 5 is a cross-sectional view of a layer structure image carrier.

FIG. 5 is a cross-sectional view showing a layer configuration of the image carrier 11 according to an embodiment of the present invention. As is shown in the drawing, on the surface of the image carrier 11 of the imaging apparatus 200, a protective layer 114 containing a filler is implemented. The image carrier 11 includes a conductive support member 111 on top of which a photoconductive layer 115 is formed, the photoconductive layer 115 being made up of a charge generating layer 112 that includes a charge generating material as its main constituent and a charge transporting layer 113 that includes a charge transporting material as a main constituent. The protective layer 114 as a surface layer is formed on top of the photoconductive layer 115. The protective layer 114 of the image carrier 11 contains filler material in order to protect the photoconductive layer 115 and enhance its durability. As for the filler material being added to the protective layer 114, white metal oxide powder such as titanium oxide, silica, alumina, or magnesium, for example, may be used. Particularly, alumina is preferably used. By adding such filler to the protective layer 114, the hardness and strength of the resin protective layer 114 may be enhanced, and grinding by the toner particles may be prevented at the contact point between the pressed cleaning blade 141 and the image carrier 11. Also, as described above, the metal salt of aliphatic acid may be applied to the protective layer 114 corresponding to the surface of the image carrier 11 so as to lower the friction coefficient. In this way, toner particles may slide more easily, and the grinding force of the toner particles may be reduced to thereby extend the service life of the image carrier 11.

The average particle diameter of the filler is preferably within a range of 0.1~0.8 μm. When the average particle diameter of the filler is too large, exposure light may scatter across the protective layer 114 to thereby degrade the resolving power. In turn, the image quality may be degraded. When the average particle diameter of the filler is too small, sufficient strength and hardness of the protective layer 114 may not be obtained, and abrasion resistance may not be desirably improved. Also, it is noted that the attenuation of the laser beam may be prevented by using filler with a high whiteness level.

The amount of filler to be added to the protective layer 114 is preferably arranged to be within a range of 10~40 wt %, and more preferably, within a range of 20~30 wt %. When the amount of filler is below 10 wt %, abrasion may occur and the durability of the protective layer 114 may be degraded. When the amount of filler is above 40 wt %, laser beam attenuation may be prominent, and sensitivity may be degraded. Also, the electrical resistance may be increased so that the potential attenuation is decreased, which is not desired for increasing the residual potential.

The protective layer 114 is formed by dispersing the filler and a binder resin using a suitable solvent, and applying the dispersed solution on the photoconductive layer 115 using the spray coating method. The binder resin, and solvent used in forming the protective layer 114 may correspond to the same materials used for the charge transporting layer 113. The film thickness of the protective layer 114 is preferably arranged to be within a range of 3~10 μm. It is noted that other additives such as a charge transporting material, and an anti-oxidation agent, may also be included in the protective layer 114.

The conductive support member 111 is preferably arranged to implement material having a conductivity of volume resistance $10^{10}$ Ωcm or lower. For example, metal such as aluminum or stainless steel that is processed into a tube structure, or metal such as nickel that is processed into an endless belt structure may be used.

The charge generating layer 112 is mainly composed of a charge generating material. For example, monoazo pigment, diazo pigment, triazo pigment, and/or phthalocyanine pigment, may be used as the charge generating material. The charge generating layer 112 may be formed by dispersing the charge generating material together with the binder resin using a solvent such as tetrahydrofuran or cyclohexanone, and applying the dispersed solution onto the conductive support member 111 through dip coating or spray coating, for example. The film thickness of the charge generating layer 112 may normally be within a range of 0.01~5 μm, and more preferably, within a range of 0.1~2 μm.

The charge transporting layer 113 may be formed by dissolving or dispersing a charge transporting material and binder resin in a suitable solvent such as tetrahydrofuran, toluene, or dichlorethane, applying the solution, and drying the coated layer. It is noted that additives such as a plasticizer and/or a leveling agent may also be included in the charge transporting layer 113 as necessary or desired. The charge transporting material may include an electron transporting material such as chloranil, bromanil, tetracyanoethylene, or tetracyanoquinodimethane, for example, and a hole transporting material such as oxazole derivatives, oxadiazole derivatives, imidazole derivatives, triphenylamine derivatives, phenylhydrazone derivatives, or alpha-phenylstilbene, for example.

The binder resin used together with the charge transporting material to form the charge transporting layer 113, may include thermal plastic resin or thermal hardening resin such as polyester resin, polyarylate resin, or polycarbonate resin. The film thickness of the charge transporting layer 113 is preferably within a range of 5~30 μm, and a suitable thickness may be determined depending on the desired photoconductive characteristics.

It is noted that an under layer may be formed between the conductive support member 111 and the photoconductive layer 115.

Figure 6:
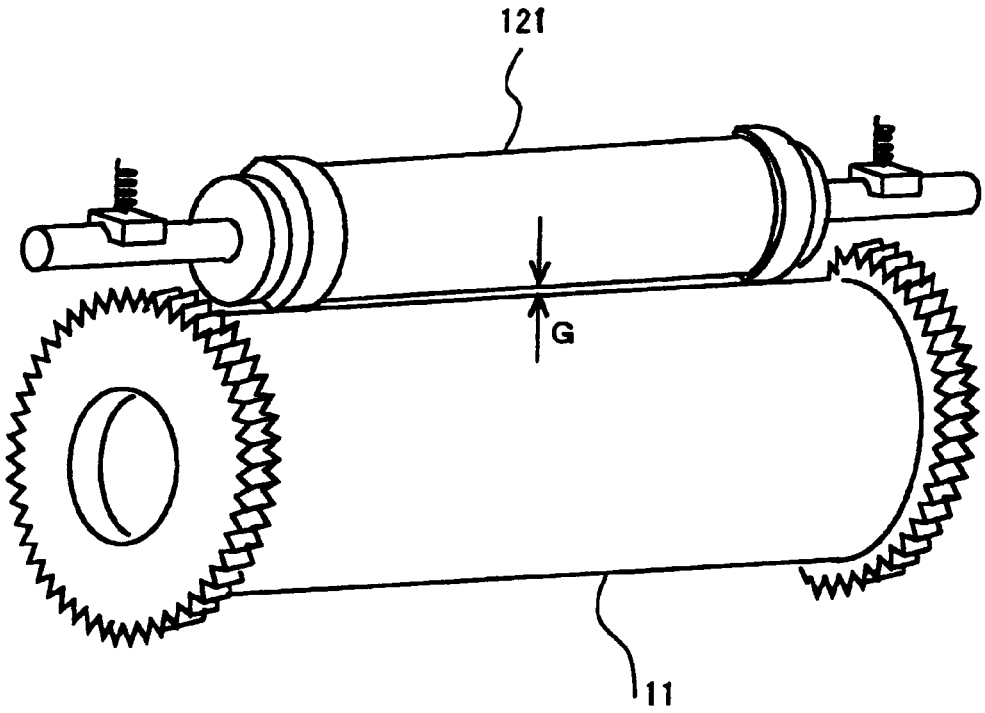
FIG. 6 is a perspective view showing an exemplary configuration of the image carrier and a charge member.

FIG. 6 is a diagram showing an exemplary configuration of the image carrier 11 and the charge roller 121 as the charge member. According to this drawing, in the imaging apparatus 200, the charge roller 121 as the charge member and the image carrier 11 are arranged to be no more than 80 μm apart but without coming into contact with one another. The charge roller 121 is not limited to a particular configuration, and may be a fixed semi-circular cylinder, for example. Alternatively, the charge roller 121 may be a cylinder of which both ends are supported by a gear or an axis support so as to be able to rotate. By arranging the charge roller 121 to have its rotation center placed slightly upstream or downstream from the contact position with the image carrier 11 with respect to the moving direction of the image carrier 11, the image carrier 11 may be evenly charged. Particularly, by arranging the charge roller 121 to be a cylinder having a curved surface, the image carrier 11 may be more evenly charged.

The residual toner particles remaining on the image carrier 11 after developing an image thereon are removed by the cleaning unit 14 that is positioned opposite the image carrier 11. However, it is difficult to remove the toner particles completely, and a small number of toner particles pass around the cleaning unit 14 and are carried to the charge unit 12. As described above, a metal salt of aliphatic acid film is formed on the image carrier 11, and when toner particles pass through the cleaning blade 141 that is pressed against the image carrier 11, metal salt of aliphatic acid sticks to the surface of the toner particles. If the particle diameter of the toner particles is greater than the width of gap G, the toner particles come into contact with the charge roller 121, and the metal salt of aliphatic acid sticks to the surface of the charge roller 121. When the metal salt of aliphatic acid is unevenly applied to the surface of the charge roller 121, an inconsistency in the electrical discharge is created, and irregularities occur such as an inconsistency in the density of the resulting image. Thereby, the gap G is preferably arranged to be greater than a maximum diameter of the toner particles used in the imaging apparatus 200.

Also, a product generated from the electrical discharge remains in a space created between the charge roller 121 and the image carrier 11, and thereby, when the space between the charge roller 121 and the image carrier 11 is reduced, the wearing of the image carrier 11 may be sped up. Accordingly, the width of the gap G is preferably arranged to be less than or equal to 80 μm, and preferably with in a range of 20~50 μm, and greater than the maximum diameter of the toner being used.

The charge roller 121 includes an axis portion and a main body. The axis portion corresponds to a core at the center of the roller structure having a diameter of 8~20 mm, for example, and may be made of hard conductive metal such as stainless steel or aluminum, or hard conductive resin with a volume resistance less than or equal to $1\times10^3$ Ω·cm, and more preferably, less than or equal to $1\times10^2$ Ω·cm, for example. The main body includes a middle resistance layer formed around the axis portion and an outer surface layer. The middle layer preferably has a volume resistance within a range of $1\times10^5$ Ω·cm~$1\times10^9$ Ω·cm, and a thickness within a range of 1~2 mm. The surface layer preferably has a volume resistance within a range of $1\times10^6$ Ω·cm~$1\times10^{10}$ Ω·cm and a thickness of approximately 10 μm. The volume resistance of the surface layer is preferably higher than the volume resistance of the middle layer.

In the imaging apparatus 200 of the present embodiment, thin line reproducibility may be improved when the volume average particle diameter Dv of toner is decreased, and from this aspect, toner with a volume average particle diameter less than or equal to 8 μm is preferably used. However, when the particle diameter of toner is decreased, the cleaning performance is degraded, and from this aspect, the particle diameter is preferably arranged to be greater than or equal to 3 μm. Particularly, development of an image on a magnetic carrier or on the surface of a development roller is difficult when using toner particles having diameters of 2 μm or less; thereby, when such toner particles make up 20 percent or more of the toner being used in the imaging apparatus 200, sufficient contact and friction with the magnetic carrier or the development roller may not be achieved for the rest of the toner particles, thereby opposite-charge toner particles may be increased, resulting in toner scattering and degradation of the image quality.

The particle diameter distribution as represented by the ratio of the volume average particle diameter Dv to the number average particle diameter Dn (Dv/Dn) is preferably within a range of 1.05~1.40. By sharpening the particle diameter distribution, the toner charge distribution may be equalized, and fogging may be reduced. When the particle diameter distribution Dv/Dn exceeds 1.40, the toner charge distribution is widened and it becomes difficult to obtain a high quality image. On the other hand, manufacturing toner with a particle diameter distribution Dv/Dn less than 1.05 is difficult and impractical. In the present example, the diameters of toner particles are measured using the Coulter Counter Multisizer (by Coulter Electronics Ltd.), for example. Specifically, an aperture of 50 μm in size is selected for measuring the toner diameter, and an average diameter of 50,000 particles are measured.

The roundness of the toner particles is preferably arranged such that the shape factor SF-1 is within a range of 100~180 and the shape factor SF-2 is within a range of 100~180.

Figure 7A:
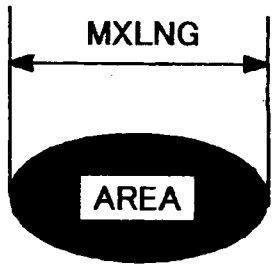
FIGS. 7A and 7B are diagrams illustrating shape factor SF-1 and shape factor SF-2 of toner particles.
Figure 7B:
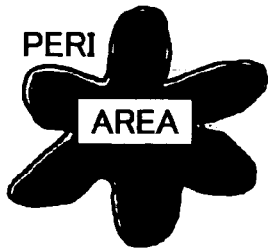

FIGS. 7A and 7B are diagrams illustrating shapes of toner particles to describe the shape factor SF-1 and the shape factor SF-2. The shape factor SF-1 indicates the roundness of a toner particle, as represented by the equation (2) shown below. Namely, the shape factor SF-1 is obtained by projecting the toner particle shape on a two-dimensional flat surface, squaring a maximum length (MXLNG) of the projected shape, dividing the squared value by the area (AREA) of the projected shape, and multiplying the divided value by 100π/4.

$$SF\text{-}1=\{(\mathrm{MXLNG})^2/\mathrm{AREA}\}\times(100\pi/4) \qquad \text{Equation (2)}$$

When the value of SF-1 is 100, this indicates that the toner particle has a complete spherical configuration, and an increase in the value SF-1 signifies a greater deviation from the spherical configuration.

The shape factor SF-2 indicates a bumpiness of a toner particle, and may be represented by the equation shown below. Namely, the shape factor SF-2 is obtained by projecting the shape of the toner particle on a two-dimensional flat surface, squaring a peripheral length of the projected shape, dividing the squared value by the area of the projected shape (AREA), and multiplying the divided value by 100π/4.

$$SF\text{-}2=\{(\mathrm{PERI})^2/\mathrm{AREA}\}\times(100\pi/4) \qquad \text{Equation (3)}$$

When the shape factor SF-2 is 100, this indicates that the surface of the toner particle is completely smooth, and an increase in the value of SF-2 signifies an increase in the bumpiness of the surface of the toner particle.

The shape factors are measured and calculated using a scanning electron microscope (e.g., S-800 by Hitachi Ltd.) and an image analyzing apparatus (LUSEX3 by Nireco Corporation), for example. Specifically, a picture of the toner particles may be taken using a scan type electronic microscope, and the toner particles may be analyzed and measured using an image analyzing apparatus.

When the shapes of the toner particles are close to spherical shapes, the toner particles touch each other and the image carrier 11 via points as opposed to planes, and therefore, the attraction force between the toner particles and the image carrier 11 is weakened. With the decrease in the attraction force between the toner particles and the image carrier 11, the mobility of the toner particles may be increased. Also, with the decrease in the attraction force between the toner particles and the image carrier 11, the transferability may be increased. However, the toner particles may easily enter the gap between the cleaning blade 141 and the image carrier 11 and the cleaning blade 141 may easily slip across the toner particles. Thereby, the shape factors SF-1 and SF-2 of the toner particles are preferably set to be greater than or equal to 100. Also, the when the shape factors SF-1 and SF-2 are increased, the toner particles tend to be dispersed on the image so that the image quality is degraded. Accordingly, the shape factors SF-1 and SF-2 are preferably set to be less than or equal to 180.

It is noted that toner particles used in the imaging apparatus 200 may alternatively have spindle shapes.

Figure 8A:
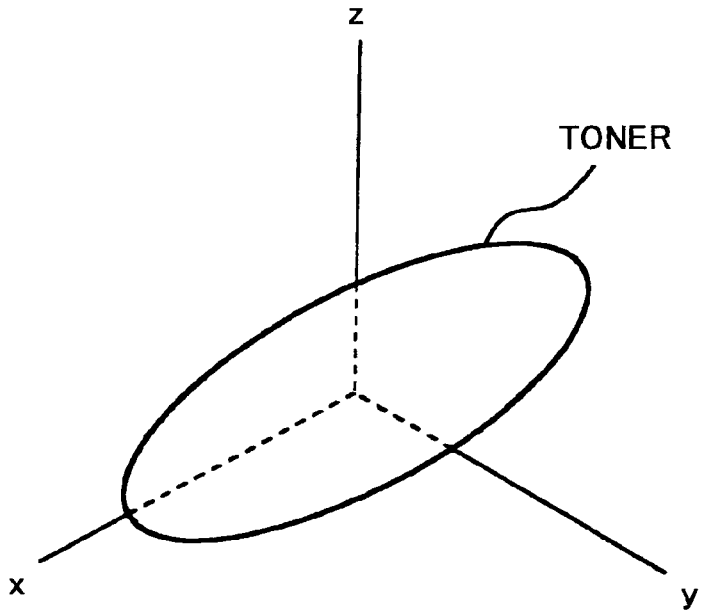
Figure 8B:
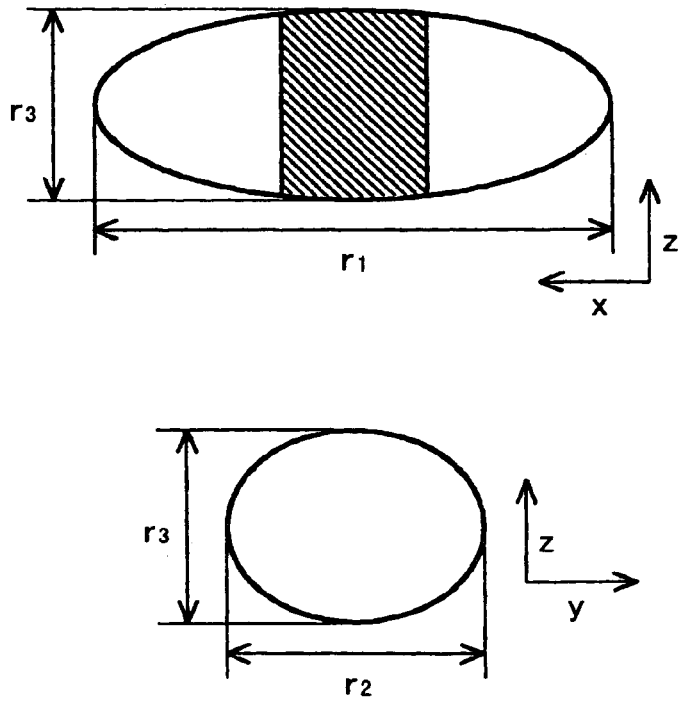

FIGS. 8A and 8B illustrate configurations of a toner particle according to such an embodiment. FIG. 8A shows an external view of the toner particle, and FIG. 8B shows a cross-sectional view of the toner particle. In FIG. 8A, the X axis represents a major axis r1 of the toner particle, the Y axis represents a minor axis r2 of the toner particle, and the Z axis represents a thickness r3 of the toner particle, wherein r1>r2≧r3.

In the present example, the toner particle has a spindle shape where the ratio of the major axis r1 to the minor axis r2 (r2/r1) is within a range of 0.5~0.8, and the ratio of the thickness r3 to the minor axis r2 (r3/r2) is within a range of 0.7~1.0. When the ratio of the major axis r1 to the minor axis r2 (r2/r1) is below 0.5, the toner particle shape deviates from a spherical shape. Thereby, although good cleaning performance may be realized, dot reproducibility and transfer efficiency may be degraded so that a high quality image may be difficult to obtain.

When the ratio of the major axis r1 to the minor axis r2 (r2/r1) exceeds 0.8, the toner particle shape is close to a spherical shape, and thereby, cleaning defects may be created, especially under a low temperature low humidity environment. Also, when the ratio of the thickness r3 to the minor axis r2 (r3/r2) is below 0.7, the toner particle shape is close to a flat-plate shape. Thereby, although toner scattering may be reduced compared to a case of using free shape toner particles with indefinite and unstable shapes, high transferability like that obtained in the case of using spherical shape toner particles cannot be obtained. When the ratio of the thickness r3 to the minor axis r2 (r3/r2) is 1.0, the toner particle may rotate with its major axis as the rotational axis. By using toner particles having spindle shapes as described above, features realized by toner particles with free/flat shapes or spherical shapes such as electrostatic charge by friction, dot reproducibility, transfer efficiency, toner scattering prevention, and good cleaning performance may be realized.

It is noted that the average length of the major axis r1 of the spindle shaped toner is preferably set to be within a range of 5~9 μm, the average length of the minor axis r2 is preferably set to be within a range of 2~6 μm, and the average of the thickness r3 is preferably set to be within a range of 2~6 μm, wherein r1>r2≧r3.

When the major axis r1 of the toner particle is below 5 μm, the cleaning performance is degraded and cleaning using the cleaning blade 141 becomes difficult. When the major axis r1 of the toner particle exceeds 9 μm, the toner may be pulverized upon being mixed with the magnetic carrier, and the pulverized toner particles that are stuck to the magnetic carrier may block the friction electrostatic charge of the other toner particles. Thereby, the toner charge distribution may be widened, and fogging and staining may occur. It is noted that the pulverizing effect described above may occur in the case of using a development roller as well. When the dimension of the minor axis r2 of the toner particle is below 2 μm, the thin line reproducibility upon image development and the transferability upon image transfer may be degraded. Also, the toner may be easily pulverized upon mixing with the magnetic carrier. When the dimension of the minor axis r2 of the toner particle exceeds 6 μm, the cleaning performance is degraded and cleaning using the cleaning blade becomes difficult. Also, when the thickness r3 of the toner particle is below 2 μm, the toner may be easily pulverized upon mixing with the magnetic carrier. When the thickness r3 of the toner particle exceeds 6 μm, the toner particle shape is close to a spherical shape, and thereby, image quality degradation such as toner scattering may occur in the electrostatic development method and electrostatic transfer method.

It is noted that in the present example, the sizes of the toner particles are measured using a scanning electron microscope (SEM). Specifically, the toner particles are observed from different perspective angles to determine their sizes.

The shapes of the toner particles may be controlled by the toner manufacturing method. For example, when toner is manufactured using the dry pulverization method, the surfaces of the toner particles may be bumpy and the toner particle shapes may be indefinite and unstable. However, by performing a mechanical or thermal process, the pulverized toner particles may be arranged to be closer to having spherical shapes. When toner is manufactured using the polymerization method such as suspension polymerization or emulsification polymerization where toner particles are created in a solution, the surfaces of the toner particles tend to be smooth and their shapes may be close to having a spherical configuration. According to this method, first, microscopic toner particles may be produced, and these particles may be condensed into a bumpy and indefinite ball configuration. Alternatively, oval-shaped or flat-plate-shaped toner particles may be created by mixing the solution and adding a shear force thereto while ingredients of the solution are still in reaction.

As described above, the cleaning performance is degraded when spherical shaped toner particles are used. This is because the toner particle surface is smooth so that the toner particles may easily roll over the surface of the image carrier 11 and slide through the gap between the cleaning blade 141 and the image carrier 11. Particularly, spherical toner particles created through wet polymerization have very few bumps on their surfaces, and thereby, cleaning defects are prone to occur. In turn, by arranging the toner particles to have spindle shapes, the rotational axis of a toner particle may be limited to a particular axis (e.g., the X axis in the example of FIG. 8) so that cleaning performance may be improved.

In the electrostatic transfer method, spherical toner particles on the image carrier 11 are easily influenced by the lines of electric force since the surfaces of the toner particles are smooth. Therefore, the toner particles have good mobility, and the adherence force between the toner particles or the toner particles and the image carrier 11 is weak. Also, since the toner particles may be faithfully transferred according to the lines of electric force, the transfer characteristics may be improved. However, when the recording medium 100 is separated from the image carrier 11, a high electrical potential may be generated between the image carrier 11 and the recording member 100 (burst effect), and the toner particles on the recording medium 100 and the image carrier 11 may be disarranged so that toner scattering occurs on the recording medium 100. Thus, spherical toner particles that are easily influenced by the lines of electric force may be prone to toner scattering and may cause image quality degradation.

Free-shaped toner or flat-shaped toner particles have bumps on their surfaces, and thereby, the toner particles are not easily influenced by the lines of electric force and are not easily transferred according to the lines of electric force so that the transfer characteristics are degraded. However, the adherence force between the toner particles is strong so that a toner dot transferred onto the recording medium 100 is not easily destroyed by an external force and toner scattering due to the burst effect may be prevented.

Spindle-shaped toner particles have smooth surfaces and a certain degree of mobility, and are thereby easily influenced by the lines of electric force. Thus, the toner particles may be faithfully transferred according to the lines of electric force, and good transfer characteristics may be realized. When the toner particles are spindle-shaped, a likely rotational axis of the toner particle may be fixed. Thereby, scattering of the toner particles from a toner dot on the recording medium 100 due to the burst effect may be prevented and a high quality image may be obtained.

In the electrostatic developing method, the spherical toner particles on the magnetic carrier or development roller are easily influenced by the lines of electric force, and may be faithfully developed according to the lines of electric force of an electrostatic latent image. In this case, good thin line reproducibility may be realized in reproducing small latent image dots since toner may be precisely and consistently placed. However, in the contact developing method, toner developed on the image carrier 11 may be moved by rubbing against the magnetic brush or the development roller, and thereby image degradation such as toner scattering may easily occur.

Free shaped toner particles and flat shaped toner particles on the magnetic carrier or the development roller have low mobility, and the lines of electric force of the latent image may not affect each of the toner particles in a consistent manner so that the toner dots may not be properly aligned upon image development. Thereby, faithful image development may be difficult, and thin line reproducibility may be degraded.

The spindle shaped toner particles may be adjusted to have a desired mobility, and thereby, a toner image may be faithfully developed according to the lines of electric force of the electrostatic latent image and good thin line reproducibility may be realized. Since the toner particles developed on the image carrier 11 are not easily moved even upon contact with the magnetic brush or the development roller, a high quality image with little image degradation from scattering may be obtained.

The spindle shaped toner particles include a protective substance protecting the surfaces of the toner particles. Details of the protective substance are described below.

As described above, the probable rotational axes of the toner particles are fixed, and for example, the X axis corresponds to the probable rotational axis in FIGS. 8A and 8B. Thus, the toner particles on the magnetic carrier, the development roller, or the image carrier 11 are likely to rotate around their X axes. In turn, a portion of the toner particle indicated by hatchings in FIG. 8B is prone to degradation from coming into contact with other elements. Specifically, a softening substance such as wax percolates through the degraded portion of the toner particle to stain the contact charge unit such as the carrier, the development roller, and the image carrier 11. In turn, hard material such as boron, silicon, titanium, zirconium, tungsten carbide, and zirconium nitride may be used as the protective substance that protects the toner particle surface. By fixing the toner surface protective substance on the surfaces of the toner particles, the protective substance is prevented from being freed from the surface of the toner to be stuck to the contact charge unit such as the carrier, the development roller, or the image carrier 11 or to damage such elements. To fix the protective substance, an external force that is greater than a force applied by a conventional external material mixing apparatus is applied.

Also it is noted that according to another embodiment, a charge control agent may also be used as the protective substance. In this way, the protective substance may provide protection as well as friction electrostatic charge functions to the toner particle surface so that the friction electric charge characteristics may be stabilized.

In the following, toner according to an embodiment of the present invention and constituent materials thereof are described.

Toner according to an embodiment of the present invention includes a charge control agent that covers the toner surface. The toner also includes a toner binder, a coloring agent, and a release agent. Preferably, the release agent is located close to the toner surface, the charge control agent is fixed to the toner surface along with organic particles, and an external additive is also applied to the toner surface.

The toner binder is preferably made of modified polyester. The modified polyester may correspond to polyester resin in which bonds other than ester bonds exist, or a state in which resin components of a polyester resin that have differing component structures are bonded through covalent bonding or ion bonding, for example. In the first example, polyester terminals may be reacted with bonds other than ester bonds. Specifically, the polyester terminal may be modified by introducing a functional group that reacts to an oxyl group or a hydroxyl group such as an isocyanate group, and causing a reaction with an active hydrogen compound, for example.

A reactant obtained from polyester prepolymer (A) and amines (B) is an example of modified polyester (i). The polyester prepolymer (A) may have an isocyanate group and may correspond to a reactant obtained from reacting polyester with polyisocyanate (3), the polyester having an active hydrogen group and corresponding to a polycondensate of polyol (1) and polycarboxylic acid (2), for example. The active hydrogen group of the polyester may correspond to a hydroxyl group (e.g., alcoholic hydroxyl group, phenol hydroxyl group), an amino group, a carboxylic group, or a mercapto group, for example, and preferably, the alcoholic hydroxyl group.

As the polyol (1), diol (1-2), and tri-polyol or higher level polyols (1-2) may be used. Preferably, diol (1-1) alone or a combination of diol (1-1) and a small amount of tri- or higher polyol (1-2) is used. As the diol (1-1), for example, alkylene glycol (e.g., ethylene glycol, 1,2-propyleneglycol, 1,3-propyleneglycol, 1,4-butanediol, 1,6-hexanediol), alkylenetherglycol (e.g., diethyleneglycol, triethyleneglycol, dipropyleneglycol, polyethyleneglycol, polypropyleneglycol, polytetramethylenetherglycol), aliphatic diol (e.g., 1,4-cyclohexanedimethanol, hydrogenerated bisphenol A), bisphenol (e.g., bisphenol A, bisphenol F, bisphenol S), alkylene oxide adducts of alophatic diols (e.g., ethyleneoxide, propylene oxide, butylene oxide), and alkylene oxide adducts of bisphenols (e.g., ethyleneoxide, propylene oxide, butylene oxide) may be used. Preferably, alkylene glycol with a carbon number of 2~12 and alkylene oxide adducts of bisphenols are used, and particularly, combined use of the alkylene oxide adducts of bisphenols and the alkylene glycol with a carbon number of 2~12 may produce desirable effects. As the tri- or higher polyol (1-2), for example, tri-(3)~octo-(8) or higher multivalent aliphatic alcohol (e.g., glycerin, trimethyol, pentaerythritol, sorbitol), tri- or higher phenols (e.g., trisphenol PA, phenol novolac, cresol novolac), and alkylene oxide adducts of tri- or more valent polyphenol may be used.

As the polycarboxylic acid (2), dicarboxylic acid (2-1) and tri- or more polycarboxylic acid (2-2) may be used, and preferably, dicarboxylic acid (2-1) alone or a combination of the dicarboxylic acid (2-1) and a small amount of tri- or more polycarboxylic acid (2-2) is used. As the dicarboxylic acid (2-1), for example, alkylene dicarboxylic acid (e.g., succinic acid, adipic acid, sebacic acid), alkenylene dicarboxylic acid (e.g., maleic acid, fumaric acid), and aromatic dicarboxylic acid (e.g., phthalic acid, isophthalic acid, terephthalic acid, naphthalenedicarboxylic acid) may be used. Preferably, alkenylene dicarboxylic acid with a carbon number of 4~20 and aromatic dicarboxylic acid with a carbon number of 8~20 are used. As the tri- or more polycarboxylic acid (2-2), for example, aromatic dicarboxylic acid with a carbon number of 9~20 (e.g., trimellitic acid, pyromellitic acid) may be used. Also, as the polycarboxylic acid (2), acid anhydride of the above substance or lower alkylester (e.g., methyl ester, ethyl ester, isopropyl ester) may used to cause reaction with the polyol (1).

The ratio of the polyol (1) and the polycarboxylic acid (2) represented by the equivalent ratio of the hydroxyl group [OH] and the carboxylic group [COOH] ([OH]/[COOH]) may normally be within a range of 2/1~1/1, preferably, within a range of 1.5/1~1/1, and more preferably, within a range of 1.3/1~1.02/1.

As the polyisocyanate (3), for example, aliphatic polyisocyanate (e.g., tetramethylenediisocyanate, hexamethylenediisocyanate, 2,6-diisocyanato methyl carproate), alicyclic polyisocyanate (e.g., isophoronediisocyanate, cyclohexylmethanediisocyanate), aromatic diisocyanate (e.g., tolylenediisocyanate, diphenylmethanediisocyanate), aromatic aliphatic diisocyanate (e.g., α, α, α', α'-tetramethylxylylenediisocyanate), isocyanurates, the above polyisocyanates that are blocked by phenol derivatives, oxime, or caprolactam, for example, and a combination of at least two of the above substances may be used.

The ratio of the polyisocyanate (3) represented by the equivalent ratio of the isocyanate group [NCO] and the hydroxyl group [OH] of the polyester having the hydroxyl group ([NCO]/[OH]) may normally be within a range of 5/1~1/1, preferably within a range of 4/1~1.2/1, and more preferably within a range of 2.5/1~1.5/1. When the ratio [NCO]/[OH] of the polyisocyanate (3) exceeds 5, low temperature adherence characteristics are degraded. When the mole ratio of [NCO] is below 1, the amount of urea contained in the modified polyester is decreased thereby resulting in the degradation of hot offset resistance. The amount of polyisocyanate (3) constituents contained in the prepolymer (A) having the isocyanate group is normally within a range of 0.5~40 wt %, preferably within a range of 1~30 wt %, and more preferably, within a range of 2~20 wt %. When this ratio is below 0.5 wt %, the hot offset resistance is degraded, and such condition may not be suitable for realizing favorable preservation characteristics against heat as well as low temperature adherence characteristics. Also, when the ratio exceeds 40 wt %, the low temperature adherence characteristics are degraded.

The number of isocyanate groups contained per molecule in the prepolymer (A) having the isocyanate group is normally 1 or more, preferably, 1.5~3 on average, and more preferably 1.8~2.5 on average. When the average number per molecule is less than 1, the urea modified polyester molecules number may be low, and the hot offset resistance may be degraded.

As the amines (B), for example, diamin (B1), tri- or more polyamine (B2), aminoalcohol (B3), aminomercaptan (B4), amino acid (B5), and blocking substances (B6) of the amino groups of B1~B5 may be used.

As the diamin (B1), aromatic diamine (e.g., phenylenediamine, diethyltoluenediamine, 4,4'-diaminodiphenylmethane), alicyclic diamine (e.g., 4,4'-diamino-3,3'-dimethyldicyclohexylmethane, diaminecyclohexane, isophoronediamine), and aliphatic diamine (e.g., ethylenediamine, tetramethylenediamine, hexamethylenediamine) may be used. As the tri- or more polyamine (B2), diethylenetriamine, and triethylenetetramine may be used, for example. As the aminoalcohol (B3), ethanol amine, and hydroxyethylaniline may be used, for example. As the aminomercaptan (B4), aminoethylmercaptan and aminopropylmercaptan may be used, for example. As the amino acid (B5), aminopropionic acid and aminocaproic acid may be used, for example. As the blocking substance (B6) of the amino groups of B1~B5, ketimine compounds and oxazoline compounds obtained from the amines B1~B5 and ketones (e.g., acetone, methyl ethyl ketone, methyl isobutyl ketone) may be used, for example. Preferably, diamin (B1) and a combination of diamin (B1) and a small amount of polyamine (B2) are used as the amines (B).

It is noted that the molecular weight of the urea modified polyester may be adjusted by using an elongation stopping agent. As the elongation stopping agent, monoamine (e.g., diethylamine, dibutylamine, butylamine, laurylamine) and blocking substances thereof (e.g., ketimine compounds) may be used, for example.

The ratio of the amines (B) represented by the equivalent ratio of the isocyanate groups [NCO] in the prepolymer (A) and the amino groups [NHx] in the amines (B) ([NCO]/[NHx]) may normally be within a range of 1/2~2/1, preferably within a range of 1.5/1~1/1.5, and more preferably within a range of 1.2/1~1/1.2. When the ratio [NCO]/[NHx] is greater than 2 or less than 1/2, the molecular weight of the urea modified polyester (i) may be low so that the hot offset resistance is degraded. According to an embodiment of the present invention, the polyester (i) modified through urea bonding may include urethane bonds as well as urea bonds. In such case, the mole ratio of the urea bonds to urethane bonds contained in the polyester (i) may normally be within a range of 100/0~10/90, preferably within a range of 80/20~20/80, and more preferably within a range of 60/40~30/70. It is noted that when the mole ratio of the urea bonds is below 10%, the hot offset resistance may be degraded.

The urea modified polyester (i) may be manufactured through the one shot method or the prepolymer method, for example. The weight average molecular weight of the urea modified polyester (i) may normally be at least 10,000, preferably 20,000~10,000,000 and more preferably 30,000~1,000,000. In this case, the peak molecular weight is preferably within a range of 1,000~10,000, and when the peak molecular weight is below 1,000, elongation reaction may be difficult to realize and the toner may lack elasticity so that the hot offset resistance is degraded. Also, when the peak molecular weight is above 10,000, problems such as the degradation of the adherence of toner, and possible pulverization of toner may arise. The number average molecular weight of the urea modified polyester (i) is not limited to a particular range in the case of using unmodified polyester (ii) as described below. In this case, number average molecular weight may be set to a suitable value for obtaining the desired weight average molecular weight. When urea modified polyester (i) is used alone, the number average molecular weight may normally be at least 20,000, preferably 1,000~10,000, and more preferably 2,000~8,000. When the number average molecular weight exceeds 20,000, low temperature adherence of the toner may be degraded and the glossiness of an image may degraded in the case of using a full-color apparatus.

Toner according to an embodiment of the present invention may include unmodified polyester (ii) as the toner binder along with the urea modified polyester (i). By using the unmodified polyester (ii) with the modified polyester (i), the low temperature adherence characteristics may be improved and the glossiness may be improved in the case of using a full-color apparatus. As the polyester (ii), polyester material identical to those of polyester (i) may be used such as the polycondensate of polyol (1) and polycarboxylic acid (2), and the preferred materials used are also identical to those for polyester (i). It is noted that the polyester (ii) may correspond to unmodified polyester as well as polyester modified through chemical bonding other than urea bonding.

For example, the polyester (ii) may correspond to polyester modified through urethane bonding. Also, it is preferable that the polyester (i) and the polyester (ii) be at least partially dissolved from the aspects of low temperature adherence and hot offset resistance. Accordingly, it is preferable that the polyester materials of polyester (i) and polyester (ii) be similar in their make-up. In the case of including polyester (ii) in the toner, the weight ratio of the polyester (i) to the polyester (ii) may normally be within a range of 5/95~80/20, preferably within a range of 5/95~25/75, and more preferably within a range of 7/93~20/80. When the weight ratio of the polyester (i) is less than 5 wt %, the hot offset resistance may be degraded, and such condition may not be suitable for realizing favorable preservation characteristics against heat as well as low temperature adherence characteristics. The peak molecular weight of the polyester (ii) may normally be within a range of 1,000~10,000, preferably within a range of 2,000~8,000, and more preferably within a range of 2,000~5,000. When this peak molecular weight is below 1,000, preservation characteristics against heat are degraded, and when the peak molecular weight exceeds 10,000, the low temperature adherence characteristics are degraded. The hydroxyl group number of the polyester (ii) may be greater than or equal to 5, preferably 10~120, and more preferably 20~80. It may be difficult to realize favorable preservation characteristics against heat as well as low temperature adherence characteristics when the hydroxyl group number is below 5. The acid number of the polyester (ii) is preferably within a range of 1~5, and more preferably within a range of 2~4. Since wax with a high acid number is used as the release agent, polyester (ii) with a low acid number may be used as the toner binder in the two-component toner to realize electrostatic charge and high volume resistance.

The glass transition point (Tg) of the toner binder used in the toner of the present embodiment may be within a range of 40~70° C., and preferably within a range of 55~65° C. When the glass transition point (temperature) is below 40° C., the preservation characteristics of the toner against heat are degraded, and when the glass transition point is above 70° C., the low temperature adherence characteristics are degraded. By at least partially including urea modified polyester resin, toner having favorable preservation characteristics against heat may be obtained with a low glass transition temperature in comparison to publicly known polyester toners.

Also, toner according to a preferred embodiment includes a release agent located close to the toner surface. Accordingly, the bonded portions of the polar groups of the modified polyester may induce negative absorption at the interface between the toner surface and the release agent, and the release agent having a low polarity may be stably dispersed. Particularly, in the case of obtaining toner particles by dissolving or dispersing toner material in an organic solution and dispersing the toner material in a water-based medium, although the bonded portions with high polarity have slight affinity for water and tend to selectively move toward the toner surface, the bonded portions may prevent the release agent particles from being exposed on the toner surface. Particularly, when 80% (particle number ratio) or a higher percentage of the release agent particles dispersed within a toner particle are dispersed around the periphery of the toner surface, a sufficient amount of the release agent may percolate from the toner particles in the fixing process, and a fixing oil may not be required. In other words, the so-called oil-less fixing may be realized. Particularly, the oil-less fixing may be realized with glossy color toner as well. On the other hand, when the release agent particles are dispersed on the toner surface in smaller amounts, durability, stability and preservation characteristics may be improved.

In the case where a volume of the release agent taking up the space between the toner surface and 1 μm into the toner particle is less than 5%, offset resistance characteristics may be inadequate. Also, in the case where the release agent takes up more than 40% of the space, thermal resistance characteristics and durability may be inadequate.

The release agent particles included in the toner of the present embodiment are preferably arranged so that particles with diameters of 0.1~3 μm make up at least 70% (particle number ratio) of the entire release agent particles. More preferably, particles with diameters of 1~2 μm make up 70% or more of the release agent particles. When a large amount of particles with diameters less than 0.1 μm are included, desired releasing characteristics may not be realized. On the other hand, when a large number of particles with diameters greater than 3 μm are included, particle mobility may be degraded and filming may occur due to flocculation, and in the case of a color toner, color reproducibility and glossiness may be degraded. The dispersion state of the release agent may be controlled by controlling the dispersion energy within the dispersion medium of the release agent and appropriately adding a dispersion agent. It is desired that the release agent rapidly percolate to the toner surface in the fixing process. In this aspect, the function of the release agent is degraded when the acid number of the release agent is increased. Thereby, in order to realize the function of the release agent, wax with an acid number below 5 KOHmg/g such as unfreed aliphatic acid Carnauba wax, rice wax, Montan ester wax, and ester wax are preferably used.

Also, fixing organic particles over the toner surface may bring the effect of inducing the release agent to percolate at the fixing stage and preventing the percolation at other times. Accordingly, for example, the problem of electrostatic charge degradation of toner due to percolation of the release agent to the toner surface in response to hazards caused by mixing at the developing unit may be resolved. The organic particles may be fixed on the toner surface by applying fine resin particles over the toner surface through fusion or in liquid, for example, to realize even distribution of the particles; however, the method of fixing the organic particles is not limited to a particular method.

As the external additive for realizing favorable mobility, characteristics, development characteristics, and electrostatic characteristics, inorganic particles are preferably used. Particularly, hydrophobic silica and hydrophobic titania are preferred. The primary particle diameter of the inorganic material is preferably within a range of 5~2,000 μm, and more preferably within a range of 5~500 μm. Also, the specific surface area of the inorganic particles according to the BET method is preferably within a range of 20~500 $m^2/g$. The use rate of the inorganic particles is preferably within a range of 0.01~5 wt % of the toner particles, and more preferably within a range of 0.01~2.0 wt %.

The inorganic particles may also correspond to alumina, barium titanate, magnesium titanate, calcium titanate, strontium titanate, zinc oxide, tin oxide, silica sand, clay, mica, wollatonite, diatomite, chromium oxide, cerium oxide, colcothar, antimony trioxide, magnesium oxide, zirconium oxide, barium sulfate, barium carbonate, calcium carbonate, silicon carbide, or silicon nitride, for example.

Also, high molecular particles such as polystyrene; metacrylate ester that may be obtained through soap-free emulsification polymerization, suspension polymerization, or dispersion polymerization; acrylate ester copolymer; polycondensates of silicone, benzoguanamine, and nylon, for example; and polymerized particles produces from thermal hardening resin may be used as well.

By applying a surface processing agent on the external additive on the toner surface, hydrophobic properties may be raised so that degradation of mobility characteristics and electrostatic characteristics may be prevented even under high humidity. For example, a silane coupling agent, a silylation agent, a silane coupling agent including the fluoroalkyl group, an organic titanate base coupling agent, an aluminum base coupling agent, silicon oil, and modified silicon oil are preferably used as the surface processing agent.

As the cleaning performance enhancement agent for removing the developing agent remaining on the image carrier 11 or a preliminary transfer medium after a transfer process, for example, zinc stearate, calcium stearate, metal salt of aliphatic acid such as stearic acid, and polymer particles manufactured through soap-free emulsification polymerization such as polymethyl methacrylate particles and polystyrene particles may be used. The polymer particles having a relatively sharp particle diameter distribution may preferably be used, wherein the volume average particle diameter thereof is set to 0.01~1 μm.

As the coloring agent of the toner, conventional dyes and pigments may be used. For example, carbon black, nigrosine dye, iron black, naphtol yellow-S, cadmium yellow, Hansa yellow (10G, 5G, G), cadmium yellow, yellow oxide, ocher, chrome yellow, titanium yellow, polyazo yellow, oil yellow, Hansa yellow (GR, A, RN, R), pigment yellow, benzidine yellow (G, GR), permanent yellow (NCG), vulcan fast yellow (5G, R), tartrazine lake, quinoline yellow lake, anthrazane yellow BGL, isoindolinone yellow, colcothar, minium, vermilion lead, cadmium red, cadmium mercury red, antimony vermilion, parmanent red 4R, para red, fire red, para-chloro-ortho-nitroaniline red, lithol fast scarlet G, brilliant fast scarlet , brilliant carmine BS, permanent red (F2R, F4R, FRL, FRLL, F4RH), fast scarlet VD vulcan fast rubin B, brilliant scarlet G , lithol rubin GX, permanent red F5R, brilliant carmine 6B, pigment scarlet 3B, bordeaux 5B, toluidine maroon, permanent bordeaux F2K, helio bordeaux BL, bordeaux 10B, BON marron light, BON marron medium, eosine lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, Cerulean Blue, alkali blue lake, peacock blue lake, Victoria blue lake, no metal-containing phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white, Litobon, and combinations thereof may be used. The percentage of coloring agent included in the toner may normally be 1~15 wt %, and more preferably 3~10 wt %.

The coloring agent may be implemented in the form of a master batch that is compounded with resin. As the binder resin being combined to manufacture the master batch, the modified or unmodified polyester resin may be used as well as copolymer of styrene such as polystyrene, poly-p-chrostyrene, and polyvinyltoluene, and substitutes thereof; styrene base copolymer such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate ester copolymer; and polymethyl methacrylate, polybutyl methacrylate, polyvinyl chloride, polyvinyl acetate, polyethylene, polypropylene, polyester, epoxy resin, epoxypolyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax alcohol on their own or combinations thereof may be used.

The master batch may be produced by mixing a master batch resin and coloring agent with high shear force and kneading the mixture. In this case, to increase the interactions between the coloring agent and the resin, an organic solvent may be used. Also, a so-called flashing method may be used in which a water-based paste containing coloring agent mixed and kneaded with resin and an organic solvent to transfer the coloring agent to the resin, after which the water and the organic solvent are removed. According to this method, a wet cake of the coloring agent may be used without having to conduct a drying process. In the mixing and kneading process, a high shear dispersion apparatus such as a 3 roll mills apparatus may be used, for example.

In the following, manufacturing processes of the toner are described.

A water-based medium used in an embodiment of the present invention may be water alone or a combination of water and a water-miscible solvent. As the water miscible solvent, for example, alcohol (e.g., methanol, isopropyl alcohol, ethylene glycol), dimethylformamide, tetrahydrofuran, cellosolves (e.g., methyl cellosolve), and lower ketones (e.g., acetone, methyl ethyl ketone) may be used.

In the present embodiment, polyester prepolymer (A) having isocyanate groups is reacted with amine (B) in a water-based medium so as to obtain urea modified polyester (UMPE). As a method for stably producing dispersed elements made of modified polyester such as urea modified polyester (UMPE) and polymer (A), for example, ingredients of toner material including modified polyester such as urea modified polyester (UMPE) and prepolymer (A) may be added to the water-based medium, after which the toner material may be dispersed by shear force. It is noted that prepolymer (A) and other ingredients of toner material such as the coloring agent, the coloring master batch, the release agent, the charge control agent, and the unmodified polyester resin (referred to as 'toner ingredients' hereinafter) may be mixed in the process of forming dispersed elements in the water-based medium; however, it is more preferable that the toner ingredients be mixed beforehand, after which the mixed toner ingredients are added to the water-based medium for dispersion. Also, it is noted that in the present embodiment, the toner ingredients other than polymer (A) such as the coloring agent, the release agent, and the charge control agent do not necessarily have to be mixed at the time particles (dispersed elements) are formed in the water-based medium; rather, these materials may be added after the formation of the particles. For example, particles that do not contain the coloring agent may be formed according to the above method, after which the coloring agent may be added according to a conventional coloring method.

The dispersion of the toner material is not limited to a particular method, and a conventional technique may be used such as the low speed shear scheme, the high speed shear scheme, the friction scheme, the high pressure jet scheme, and the ultrasonic scheme. It is noted that in order to obtain dispersed elements with particle diameters in a range of 2~20 μm, the high speed shear scheme is preferably used. In the case of using the high speed shear dispersion apparatus, although the rotational speed is not limited to a particular number, this is normally set to 1,000~30,000 rpm, and preferably 5,000~20,000 rpm. Also, the dispersion time may normally be set to 0.1~5 minutes in the case of using a batch scheme although the present embodiment is not limited to this range. The temperature at the time of dispersion may normally be set to 0~150° C. (under pressure), and preferably 40~98° C. It is noted that the viscosity of the dispersed elements made of urea modified polyester and prepolymer (A) may be lower when a high temperature is set, which may facilitate the dispersion process.

The amount of the water-based medium used with respect to 100 units of toner material including urea modified polyester and polymer (A) may normally be within a range of 50~2,000 weight units, and preferably within a range of 100~1,000 weight units. When this amount is less than 50 weight units, the dispersion state of the toner material may be degraded, and toner particles of predetermined diameters may not be obtained. On the other hand setting this amount to exceed 2,000 is not practical from an economic standpoint. Also, a dispersing agent may be used as necessary or desired. By using a dispersing agent, the particle size range may be narrowed and stable dispersion may be realized.

It is noted that various types of dispersing agents may be used to emulsify and disperse oil-based toner material dispersed in a water-based solution. For example, a surface active agent, an inorganic particle dispersing agent, and a polymer particle dispersing agent may be used as the dispersing agent.

As the surface active agent, for example, anionic surface active agents such as alkylbenzene sulfonate salt, alpha-olefinsulfonate salt, and phosphate ester; amine salt cationic surface active agents such as alkylamine salt, an aminoalcohol fatty acid derivative, a polyamine fatty acid derivative, and imidazoline; quaternary ammonium salt cationic surface active agents such as alkyltrimethylammonium salt, dialkyldimethylammonium salt, alkyldimethylbenzylammonium salt, pyridinium salt, alkylisoquinolinium salt, and benzethonium chloride; nonionic surface active agents such as a fatty amide derivative, and a multivalent alcohol derivative; and ampholytic surface active agents such as alanine, dodecyl (aminoethyl) glycine, di(octylaminoethyl)glycine, N-alkyl-N, and N-dimethylammonium betaine may be used.

Also, by using a surface active agent including the fluoroalkyl group, effective results may be obtained with a small amount. For example, fluoroalkylcarboxylic acid and metal salt thereof, disodium perfluorooctanesulfonylgultamate, sodium 3-[omega-fluoroalkyl (C6-C11) oxy]-1-alkyl (C3-C4) sulfonate, sodium 3-[omega-fluoroalkanoyl (C6-C8)-N-ethylamino]-1-propanesulfonate, fluoroalkyl (C11-C20) carboxylic acid and metal salt thereof, perfluoroalkylcarboxylic acid (C7-C13) and metal salt thereof, perfluoroalkyl (C4-C12) sulfonic acid and metal salt thereof, perfluorooctanesulfonic acid diethanolamide, N-propyl-N-(2-hydroxyethyl)-perfluorooctanesulfonamide, propyltrimethylammonium salt of a perfluoroalkyl (C6-C10) sulfonamide, salt of perfluoroalkyl (C6-C10)-N-ethylsulfonylglycine, and monoperfluoroalkyl (C6-C16) ethyl phosphate ester may preferably be used.

Surflon S-111, S-112, S-113 (by Asahi Glass Co., Ltd.), Florad FC-93, FC-95, FC-98, FC-129 (by Sumitomo 3M Co., Ltd.), Unidyne DS-101, DS-102 (by Daikin Industries Co., Ltd.), Megaface F-110, F-120, F-113, F-191, F-812, F-833 (Dainippon Ink and Chemicals Inc.), Ektop EF-102, 103, 104, 105, 112, 123A, 123B, 306A, 501, 201, 204 (by Tohkem Products Co., Ltd.), and Ftergent F-100, F-150 (by Neos Co., Ltd.) are exemplary product names of the above agents that may be used in the present embodiment.

As the surface active agent, for example, aliphatic mono-/di-/tri-amine including the fluoroalkyl group, aliphatic quaternary ammonium salt such as propyltrimethylammonium salt of a perfluoroalkyl (C6-C10) sulfonamide, benzalkonium salt, benzethonium chloride, pyridinium salt, and imidazolinium salt may be used. As for product names, for example, Surflon S-121 (by Asahi Glass Co., Ltd.), Florad FC-135 (by Sumitomo 3M Co. Ltd.), Unidyne DS-202 (by Daikin Industries Co., Ltd.), Megaface F-150, F-824 (by Dainippon Ink Inc.), Ektop EF-132 (by Tohkem Co., Ltd.), Ftergent F-300 (by Neos Co., Ltd.) may be used.

As the inorganic particle dispersing agent, for example, calcium phosphate, calcium carbonate, titanium oxide, colloidal silica, and hydroxyapatite may be used as inorganic compound dispersing agents that are not easily soluble in water.

Also, by using the polymer particle dispersing agent, an effect similar to that of the inorganic particle dispersing agent may be obtained. For example, MMA polymer particles of 1 μm and 3 μm, styrene particles of 0.5 μm and 2 μm, styrene-acrylonitrile polymer particles of 1 μm, (e.g., PB-200H by Kao Co., Ltd, SGP by Soken Co., Ltd., Technopolymer SB by Sekisui Plastics CO., Ltd., SGP-3G by Soken Co., Ltd., Micropearl by Sekisui Fine Chemicals Co., Ltd.) may be used.

Also, a dispersing agent such as a high molecular protective colloid may be used in combination with the inorganic dispersing agent or the polymer particles to stabilize the dispersion solution. For example, acids such as acrylic acid, metacrylic acid, alpha-cyanoacrylic acid, alpha-cyanomethacrylic acid, itaconic acid , crotonic acid, fumaric acid, maleic acid, and maleic anhydride; (meth)acrylic monomer with a hydroxyl group such as beta-hydroxyethyl acrylate, beta-hydroxyethyl methacrylate, beta-hydroxypropyl acrylate, beta-hydroxypropyl methacrylate, gamma-hydroxypropyl acrylate, gamma-hydroxypropyl methacrylate, 3-chloro-2-hydroxypropyl acrylate, 3-chloro-2-hydroxypropyl methacrylate, ester from diethylene glycol and monoacrylic acid, ester from diethylene glycol and monomethacrylic acid, ester from glycerin and monoarylic acid, ester from glycerin and monometharylic acid, N-methylolacrylamide, and N-methylolmethacrylamide; vinyl alcohol and ethers from materials containing vinyl alcohol such as vinyl methyl ether, vinyl ethyl ether, vinyl propyl ether; ethers of compounds including vinyl alcohol and a carboxylic group such as vinyl acetate, vinyl propionate, ninyl butyrate; acrylamide, methacrylamide, diacetone acrylamide, and methylol compounds thereof; acid chlorides such as acryloyl chloride and methacryloyl chloride; homopolymer or copolymer of nitrogen atoms or atoms having heterocyclic functions thereof such as vinylpyridine, vinylpyrrolidone, vinylimidazol, ethyleneimine; polyoxyethylene based elements such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester; and celluloses such as methylcellulose, hydroxyethylcellulose, and hydroxypropylcellulose may be used.

Then, in order to remove the organic solvent from the emulsified dispersed element obtained from the reaction, the temperature is gradually raised in a laminar mixing state, and the element is mixed with a strong force at a predetermined temperature range, after which the solvent removing process is conducted to thereby obtain spindle shaped toner particles. It is noted that in the case of using a dispersing agent that is easily soluble in acid and alkali such as calcium phosphate, the calcium phosphate may be dissolved by acid such as hydrochloric acid, and water may be used to wash and remove the calcium phosphate from the toner particles. Other methods such as decomposition by enzyme may also be used for the removal process. Alternatively, a dispersing agent used in the dispersing process may be left on the surfaces of the toner particles. In a case where a solvent is used, the solvent may be removed from the reactant obtained from an elongation and/or a cross-linking reaction caused by the amine of the modified polyester (prepolymer), the removal being performed under normal pressure or low pressure.

By adjusting the solvent removal conditions, the shapes of the toner particles may be adjusted. For example, in order to adjust the diameters of depressions formed on the toner surface, the solid ratio of the oil-based material (oil stratum) emulsified and dispersed in the water-based medium may be set to 5~50%, the solvent removal temperature may be set to 10~50° C., and the duration of the solvent removal process may be set to be within 30 minutes. Since the solvent contained in the oil stratum may evaporate in a short period of time, the elastic oil stratum may harden and contract unevenly at a relatively low temperature. When the oil stratum solid ratio is above 50%, the amount of evaporating solvent may be small, and contraction features of the oil stratum may be degraded. When the solid ratio is below 5%, productivity may be lowered. Also, when the time (duration) of the removal process is long, contraction is less likely to occur and the toner particles may have more spherical shapes. However, it is noted that the above condition is not an absolute requirement, and the temperature and the solvent removal time may be balanced according to desired effects.

In order to lower the viscosity of the dispersing medium of the toner material, a solvent that can dissolve polyester of such as the urea modified polyester and prepolymer (A) may be used. By using a solvent, the particle size distribution may be desirably controlled. Preferably, the solvent corresponds to a volatile solvent with a boiling point below 100° C. in order to facilitate the removal process. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methy lethyl ketone, and methyl isobutyl ketone, on their own and combinations thereof may be used as the solvent. Particularly, aromatic solvents such as toluene and xylene, and halogenated hydrocarbon such as methylene chloride, 1,2-dichloroethane, chloroform, and carbon tetrachloride are preferably used. The amount of solvent used with respect to 100 units of prepolymer (A) may normally be within a range of 0~300 units, preferably 0~100 units, and more preferably 25~70 units.

The elongation and/or cross linking reaction time may be determined depending on the structure of the isocyanate group included in the prepolymer (A) and the reaction from combining the amines (B), for example. Normally, the reaction time may be set to 10~40 hours, and preferably 2~24 hours. The reaction temperature may normally be set to 0~150° C., and preferably 40~98° C. Also, a conventional catalyst may be used as necessary or desired. Specifically, dibutyl tin laurate and dioctyl tin laurate, for example, may be used as the catalyst. As the elongation and/or cross-linking agent, the amines (B) described above may be used.

According to an embodiment of the present invention, a shape controlling process of mixing the dispersed solution (reactant solution) obtained from the elongation and/or cross-linking reaction in a mixing chamber having smooth walls is implemented before the solvent removal process of removing the solvent contained in the dispersed solution. Preferably, the solution is mixed with a strong mixing force, after which the solvent removal process is performed at a temperature of 10~50° C. By performing the shape controlling process before the solvent removal process, the shapes of the toner particles may be controlled. For example, in the shape controlling process, the emulsified solution that is dispersed and emulsified in the water-based medium and elongated may be mixed with a strong mixing force in a mixing chamber at a temperature of 30~50° C., and after confirming that toner particles in spindle shapes are formed, the solvent removal process may be performed at a temperature of 10~50° C. It is noted that the shape controlling conditions are not limited to the above conditions, and the conditions may be suitably adjusted. By applying a strong mixing force to the solution at the mixing chamber, after the solution is dispersed, emulsified, and elongated, shearing of the toner particles may be realized and spindle shaped toner particles may be created. Specifically, substances such as ethyl acetate contained in the particles may lower the viscosity of the emulsified solution, and when a strong mixing force is applied, the shapes of the particles may change from spherical shapes to spindle shapes. Accordingly, the volume average particle diameter Dv of the toner, the number average particle diameter Dn of the toner, the ratio thereof Dv/Dn, and the spindle shapeliness ratio, may be controlled by adjusting the water stratum viscosity, the oil stratum viscosity, and the characteristics and amount of the resin particles, for example.

Toner according to an embodiment of the present invention may be used as a two-component developer. In such case, the toner may be mixed with a magnetic carrier. The ratio of the toner with respect to the magnetic carrier included in the two-component developer may preferably be arranged such that 1~10 weight units of toner are included per 100 weight units of the carrier. As the magnetic carrier, conventional magnetic carriers such as iron powder, ferrite powder, magnetite powder, and magnetic resin carriers with particle diameters of 20~200 μm may be used. As the covering material, for example, acrylic resin, fluororesin, and silicon resin may be used. Also, conductive power and other substances may be included in the resin covering as necessary or desired.

According to another embodiment, the toner may correspond to magnetic toner or non-magnetic toner of a single component developer that is not used with a magnetic carrier.

In the following, operations of the imaging apparatus 200 of FIG. 1 are described.

A recording medium 100 sent from the paper feeder 3, 4, or the manual feeder tray MF is guided by a carrier guide (not shown) while being carried by a carrier roller (not shown) to reach a halt position at which a pair of resist rollers 5 are implemented. The recording medium 100 released by the resist rollers 5 at a predetermined timing is held by the transfer carrier belt 60 and is carried across the image forming units 1Y, 1M, 1C, and 1K to pass through their respective transfer portions. The toner images developed on the image carriers 11Y, 11C, 11M, and 11K of the image forming units 1Y, 1M, 1C, and 1K are placed in contact with the recoding medium 100 at their respective transfer portions, and the transfer images are transferred onto the recording medium 100 by the effects of the transfer electric field and the nip pressure, for example. Through this transfer process, a full color toner image may be formed on the recording medium 100. After the toner image transfer process, the surfaces of the image carriers 11Y, 11M, 11C, and 11K are cleaned by the cleaning unit 14, after which electrostatic charge is removed therefrom. In this way, preparation for a next electrostatic image formation process is made. The recording medium 100 having the full color toner image formed thereon is carried to a fixing unit 7 so that the full color image may be fixed. Then, the recording medium 100 is guided in a first paper delivery direction B or a second paper delivery direction C according to the turning direction of a switching guide D. In the case where the recording medium 100 is guided in the first paper delivery direction B to be discharged into the delivery tray 8, the recording medium 100 is stacked onto the delivery tray 8 in a so-called face-down state where the image printed side faces downward. In the case where the recording medium 100 is guided in the second paper delivery direction C, for example, the recoding medium 100 may be carried to another post processing apparatus such as a sorter or a stapler (not shown), or the recording medium may go through a switch back unit to be carried back to the resist rollers 5 for dual side printing.

A process cartridge according to an embodiment of the present invention corresponds to a detachable process cartridge that is implemented in the imaging apparatus 200 in a manner such that at least one of the image carrier 11, the charge unit 12, the developing unit 13, and the cleaning unit 14 supports the processing cartridge, wherein the average roundness Ψ of the toner used in the processing cartridge is within a range of 0.93~0.99, the friction coefficient μs of the image carrier 11 satisfies the condition $\mu s \leqq 3.6-3.3\times$average roundness Ψ. In this way, the friction coefficient μs of the image carrier 11 may be controlled to a small value even when the average roundness Ψ of the toner has a large value, and thereby, cleaning performance may be improved and a high quality image may be obtained.

As can be appreciated from the above descriptions, in an imaging apparatus according to an embodiment of the present invention, by controlling the toner particle shape and the friction coefficient of the image carrier, transfer characteristics as well as cleaning characteristics may be improved, and thereby, toner scattering or staining may be prevented and a high quality image may be obtained. Also, since the charge member is protected from soiling, an evenly formed high quality image may be obtained. Also, the service life of the image carrier and the cleaning blade may be increased.

Toner according to an embodiment of the present invention has improved transferability so that accurate image transfer may be realized. A process cartridge according to an embodiment of the present invention has improved durability from increasing the service life of the image carrier and the cleaning blade.

Further, the present invention is not limited to these embodiments, and variations and modifications may be made without departing from the scope of the present invention.

What is claimed is:

1. An image forming apparatus including:

an image carrier that is adapted to form a latent image; and a toner that is adapted to develop the latent image, wherein an average roundness ψ of the toner is within a range of 0.93-0.99, and a friction coefficient μs of the image carrier satisfies a condition, friction coefficient $\mu s \leqq 3.6-3.3\times$average roundness ψ.

2. The image forming apparatus as claimed in claim 1, wherein an average roundness ψ of the toner corresponds to a value obtained by optically measuring a dimension of a toner particle and dividing the measured dimension of the toner particle by a circumference of a circle having an area equivalent to a projected area of the toner particle.

3. The image forming apparatus as claimed in claim 1, wherein the friction coefficient μs of the image carrier is measured using an oiler belt system.

* * * * *

UNITED STATES PATENT AND TRADEMARK OFFICE

CERTIFICATE OF CORRECTION

PATENT NO. : 7,386,257 B2
APPLICATION NO. : 11/377180
DATED : June 10, 2008
INVENTOR(S) : Koike et al.

It is certified that error appears in the above-identified patent and that said Letters Patent is hereby corrected as shown below:

On the title page, the Terminal Disclaimer information has been omitted. Item (45) and the Notice information should read as follows:

-- (45) **Date of Patent: *Jun. 10, 2008**

(*) Notice: Subject to any disclaimer, the term of this patent is extended or adjusted under 35 U.S.C. 154(b) by 92 days.

This patent is subject to a terminal disclaimer. --

Signed and Sealed this

Twenty-second Day of December, 2009

David J. Kappos

David J. Kappos
*Director of the United States Patent and Trademark Office*